United States Patent [19]

Seki et al.

[11] Patent Number: 5,054,766

[45] Date of Patent: Oct. 8, 1991

[54] PAPER POSITIONING DEVICE

[75] Inventors: Nobuyoshi Seki; Nobuyuki Morii; Takashi Komada; Masatoshi Hosoi; Yoshihide Sugiyama; Atuhisa Hujiwara; Masashi Shimada; Tsutomu Ichinose; Yuji Ueno, all of Nagoya; Goro Mori, Tokyo; Toshiyuki Kikuchi, Tokyo; Masahiro Minato, Tokyo; Shin Umeda, Tokyo; Hirobumi Yoshino, Tokyo, all of Japan

[73] Assignee: Ricoh Company, Ltd., Tokyo, Japan

[21] Appl. No.: 462,760

[22] Filed: Jan. 10, 1990

[30] Foreign Application Priority Data

| | | | |
|---|---|---|---|
| Jan. 19, 1989 | [JP] | Japan | 1-4588[U] |
| Jan. 19, 1989 | [JP] | Japan | 1-4589[U] |
| Jan. 19, 1989 | [JP] | Japan | 1-8467 |
| Jan. 19, 1989 | [JP] | Japan | 1-8468 |
| Jan. 19, 1989 | [JP] | Japan | 1-8469 |
| Jan. 19, 1989 | [JP] | Japan | 1-8470 |
| Jan. 19, 1989 | [JP] | Japan | 1-8471 |
| Jan. 19, 1989 | [JP] | Japan | 1-8472 |
| Jan. 19, 1989 | [JP] | Japan | 1-8473 |
| Dec. 8, 1989 | [JP] | Japan | 1-319989 |

[51] Int. Cl.[5] ..... B65H 31/31

[52] U.S. Cl. ..... 271/221; 271/222

[58] Field of Search ..... 271/220, 221, 222, 223, 271/224, 241

[56] References Cited

U.S. PATENT DOCUMENTS

| | | | |
|---|---|---|---|
| Re. 30,031 | 6/1979 | Snellman | 271/222 |
| 3,910,568 | 10/1975 | Brown et al. | 271/221 |
| 3,944,217 | 3/1976 | Greene et al. | 271/223 |
| 4,325,544 | 4/1982 | Magno et al. | 271/221 |
| 4,478,405 | 10/1984 | Eertink et al. | 271/227 |

*Primary Examiner*—H. Grant Skaggs
*Assistant Examiner*—C. Druzbick
*Attorney, Agent, or Firm*—Oblon, Spivak, McClelland, Maier & Neustadt

[57] ABSTRACT

A paper positioning device having a paper positioning member which is pivotable in abutment against one edge of a paper sheet loaded on a receptacle for moving the paper sheet to a positioning position for thereby positioning the paper sheet. By a simple mechanism and control, the movement of the paper positioning member is slowed down at the positioning position and accelerated until the positioning member reachines it. The paper positioning member performs a pivoting movement twice while a drive shaft associated therewith performs a reciprocating movement once. The device is, therefore, no only durable but also positions paper sheets efficiently and positively without damaging the paper sheets.

9 Claims, 30 Drawing Sheets

PAPER POSITIONING DEVICE

BACKGROUND OF THE INVENTION

The present invention relates to a device for positioning paper sheets which are sequentially driven out of a copier, facsimile machine, printer or similar image forming apparatus.

A sorter is available with a copier, for example, for collating or sorting paper sheets coming out of the copier into a plurality of bins. Positioning such paper sheets sequentially stacked on a bin, or receptacle, such that their four sides are accurately regulated is desirable from the handling standpoint. A neatly arranged paper stack can be stapled, punched, or otherwise treated, as desired. A device having a paper positioning member which is pivotable in abutment against one edge of paper sheets is known in the art.

However, none of prior art paper positioning devices of the type having a pivotable paper positioning device as mentioned above gives consideration to the moving speed of the paper positioning member, i.e., it has been customary to maintain the speed substantially constant. Specifically, when the pivoting speed is high, the paper positioning member abuts against one edge of a paper sheet with an excessive force. Hence, as the paper sheet is moved toward a paper positioning position and then restricted by a side wall or similar member of a receptacle, the resulting impact is apt to damage the edge of the paper sheet. At the same time, such an excessive force generates an excessive repulsive force in the paper sheet. Then, it is likely that the paper sheet once positioned is dislocated as the paper positioning member retracts away from the edge thereof.

Although the pivoting speed of the paper positioning member may be lowered to eliminate the above problem, a decrease in the pivoting speed directly translates into a decrease in paper handling efficiency. Specifically, a sorter or similar paper handling device for use with a copier, for example, is designed to operate at a higher linear velocity than the copier body. Therefore, a paper handling apparatus with such a low pivoting speed cannot follow the linear velocity of the copier body and, in turn, requires the linear velocity of the copier body to be lowered, resulting in low productivity of the entire copying system.

The prior art paper positioning member pivots only once while driving means associated therewith is operated once, i.e., it cannot pivot twice unless the driving means performs a predetermined angle of reciprocating rotary motion twice. The two pivoting movements is, therefore, not practicable without resorting to complicated control and without sacrificing the durability of the control and drive systems.

A paper positioning device is disclosed in Japanese Patent Laid-Open Publication (Kokai) No. 59-177251. This prior art device has a fence (paper edge receiving member) which protrudes upward from the sheet receiving surface of a receptacle, and a paper positioning member located to face the fence and movable toward and away from the fence. After paper sheets have been stacked on the receptacle between the fence and the paper positioning member, the positioning member is moved toward the fence to position the paper stack in cooperation with the fence. The paper positioning member is implemented as a simple positioning rod. A drawback with this scheme is that when the paper sheets are curled upward away from the receptacle, they slip upward when pushed by the paper positioning member at one side thereof. When the positioning rod itself or the receptacles have errors ascribable to the fabrication stage or the assembly stage or when the paper sheets are not uniform in length, paper sheets cannot be accurately positioned in some receptacles although they may be done so in the other receptacles. Another drawback with this prior art implementation is that such a paper positioning member or rod has to be located at opposite sides of paper sheets. This, coupled with the fact that the plurality of positioning means rotate individually for positioning paper sheets, makes it difficult to position paper sheets at a predetermined position with accuracy.

A paper positioning device capable of dealing with paper sheets of various sizes is disclosed in U.S. Pat. No. 3,910,568, for example. This prior art scheme positions paper sheets by varying the pivoting angle of a paper positioning member in matching relation to the paper size. Specifically, the pivoting angle is increased for comparatively small paper sizes and decreased for comparatively large paper sizes. However, the position at which the paper positioning member abuts against paper sheets changes from one paper size to another, so that the positioning accuracy is lowered depending on the paper size.

Another prior art paper positioning device is constructed such that a paper sheet is positioned on an inclined bin due to gravity, i.e., only in a direction perpendicular to an intended direction of paper entry. In this type of device, a paper positioning member is caused into a pivoting motion as soon as a paper sheet enters a bin with no consideration given to the timing for driving the positioning member relative to the movement of the paper sheet. Hence, the accuracy of positioning which relies on gravity as mentioned above is apt to decrease.

Regarding the amount of pivoting motion of the paper positioning member, all the prior art devices move it just to one widthwise edge of a paper sheet. This brings about a problem that when the width of paper sheets is short of a predetermined width due to errors or when they are curled, the positioning member fails to urge the paper sheets against the fence and, therefore, to position them accurately.

A paper positioning device is built not only in a sorter which is operable with an image forming apparatus but also in a finisher and an intermediate tray of a copier having a two-side copying function, etc. For such an application, the device has a table having a flat surface, and a rotatable plate positioned on the table. Every time a paper sheet is introduced into the device such that it extends over a horizontal portion of the rotatable plate and the table, the plate is moved toward the edge of the paper sheet to position the paper sheet. The paper sheet is laid not only on the table but also on the horizontal portion of the rotatable plate as mentioned above, so that a pushing portion of the plate may surely abut against the edge of the paper sheet. However, the paper sheet, especially the paper sheet laid on the table first, is apt to get into between the table and the horizontal portion of the rotatable plate. Then, the rotatable plate will miss the edge of the paper sheet when rotated for positioning purpose.

SUMMARY OF THE INVENTION

It is therefore an object of the present invention to provide a paper positioning device which is free from the drawbacks particular to the prior art as discussed above.

It is another object of the present invention to provide a paper positioning device capable of positioning paper sheet accurately, efficiency and surely with a simple structure and control.

It is another object of the present invention to provide a generally improved paper positioning device.

A paper positioning device of the present invention comprises a receptacle for receiving a paper sheet, and a paper positioning member pivotable in abutment against an edge of the paper sheet loaded on the receptacle for moving the paper sheet from a position where the paper sheet is laid to a positioning position.

Also, a paper positioning device having a pivotable paper positioning member which abuts against an edge of a paper sheet loaded on a paper receiving surface of a receptacle for moving the paper sheet from a loaded position to a paper positioning position of the present invention comprises a driving mechanism comprising a drive shaft for imparting a torque, a crank mechanism comprising a connecting member driven by the driving mechanism in a rotary motion about the drive shaft, and an arm having at one end an engaging portion in which the connecting member is slidably received and being rotatable about a fulcrum defined at the other end in response to a rotary motion of the connecting member, a rotatable shaft rigidly connected to the fulcrum and rotatable in response to rotation of the arm, the paper positioning member being mounted on the rotatable shaft, and a control for controlling the driving mechanism such that the drive shaft is rotated in one direction for causing the paper positioning member to pivot and, after the paper positioning member has passed a maximum pivoting position, rotated in the other direction, the paper positioning member being moved at a lower speed when moved the paper sheet to the paper positioning position than when moving it toward the paper positioning position.

Further, a paper positioning device for use in a sorter for positioning stacks of paper sheet loaded on a plurality of receptacles which are arranged in an array of present invention comprises a rotatable shaft rotatable about an axis of the rotatable shaft which extends transversely to paper receiving surfaces of the receptacles, paper positioning members mounted on the rotatable shaft and each being associated with respective one of the receptacles, an elastic pushing member affixed to a free end of each of the paper positioning members remote from the rotatable shaft, a driving mechanism for rotating the rotatable shaft by an angle which allows the elastic pushing member to move at least between a position where the elastic pushing member does not contact an edge of the paper stack loaded on associated one of the receptacles and a position where it contacts the edge of the paper stack, a first stop member for stopping a movement of the paper sheet in one direction, and a second stop member for stopping a movement of the paper sheet in a direction perpendicular to the one direction. The elastic pushing member is caused into abutment against the paper sheet in a direction for urging the paper sheet against the first stop member and second stop member. The paper positioning member is pivotally moved, at the time of positioning the paper stack, toward the first stop member until the distance between the first stop member and the elastic pushing member becomes slightly smaller than a width of the paper sheet and does not become 10 millimeters smaller than the width.

In accordance with the present invention, in a paper positioning device comprising a pivotable paper positioning member which abuts against an edge of the paper sheet loaded on a paper receiving surface of a receptacle for moving the paper sheet from a loaded position to a paper positioning position, the paper positioning member is moved at a lower speed when moving the paper sheet to the paper positioning position than when moving it toward the paper positioning position.

Further, a paper positioning device comprising a pivotable paper positioning member which abuts against an edge of a paper sheet loaded on a receptacle for positioning the paper sheet of the present invention comprises a driving mechanism comprising a drive shaft for imparting a torque, a connecting member driven by the driving mechanism in a rotary motion about the drive shaft, an arm having at one end an engaging portion in which the connecting member is slidably received and being rotatable about a fulcrum defined at the other end in response to a rotary motion of the connecting member, a rotatable shaft rigidly connected to the fulcrum and rotatable in response to rotation of the arm, the paper positioning member being mounted on the rotatable shaft and pivotable into abutment against the edge of the paper sheet, and a control for controlling the driving mechanism such that the drive shaft is rotated in one direction for causing the paper positioning member to pivot and, after the paper positioning member has passed a maximum pivoting position, rotated in the other direction.

Further, a paper positioning device for positioning a stack of paper sheets sequentially discharged one by one through an inlet of a receptacle and stacked on a paper receiving surface of the receptacle of the present invention comprises a paper end receiving member protruding from the paper receiving surface of the receptacle for receiving one end of the stack, a paper positioning member located to face the paper end receiving member and movable toward and away from the paper end receiving member, and an auxiliary elastic member affixed to the paper positioning member at a level slightly higher than a thickness of the stack as measured from the paper receiving surface of the receptacle. The auxiliary elastic member is spaced away from the paper receiving surface more at an upstream side with respect to an intended direction of paper discharge than at a downstream side and being sequentially inclined toward the paper receiving surface from the upstream side.

Further, a paper positioning device for use in sorter for positioning stacks of paper sheets loaded on a plurality of receptacles which are arranged in an array of the present invention comprises a rotatable shaft rotatable about an axis of the rotatable shaft which extends transversely to paper receiving surfaces of the receptacles, a paper positioning member rigidly mounted on the rotatable shaft and each being associated with respective one of the receptacles, an elastic pushing member affixed to a free end of the paper positioning member remote from the rotatable shaft and a driving mechanism for rotating the rotatable shaft by an angle which allows the elastic pushing member to move at least between a position where the pushing member does not contact an edge of the stack loaded on associated one of the receptacles and a position where it contacts the edge of the stack.

Further, a paper positioning device of the present invention comprises a receptacle, a paper positioning member pivotable in abutment against an edge of a paper sheet which is loaded on the receptacle, the receptacle selectively receiving paper sheets of a plurality of sizes, the paper positioning member being pivotable at a plurality of positions each being associated with respective one of the plurality of sizes, and a moving device for moving the paper positioning member to any one of the plurality of positions depending on the size of paper sheets.

Further, a paper positioning device of the present invention comprises a receptacle for selectively receiving paper sheets of a plurality of sizes, a paper positioning member pivotable in abutment against an edge of the paper sheets while being held at any one of predetermined stop positions each being associated with respective one of the plurality of sizes, a moving device for moving the paper positioning member to any one of the stop positions depending on the size, a size sensor for sensing a position of the paper positioning member, and a control for stopping a movement of the paper positioning member when the size sensor senses that the paper positioning member has reached one of the stop positions associated with the size of the paper sheets discharged.

Further, a paper positioning device of the present invention comprises a receptacle inclined upward from an upstream side toward a downstream side with respect to an intended direction of paper discharge for receiving a paper sheet discharged onto the receptacle, a paper positioning member pivotable in abutment against an edge of the paper sheet which extends in parallel to the intended direction of paper discharge, a stop member for stopping the paper sheet which drops toward the upstream side with respect to the intended direction of paper discharge, a sensor for sensing that the paper sheet has been fully discharged onto the receptacle, and a control for causing the paper positioning member pivoting movement on the lapse of a predetermined period of time after the sensor has sensed the discharge of the paper sheet.

Further, a paper positioning device of the present invention comprises a receptacle for stacking paper sheets sequentialy discharged through a paper discharging section, and a paper positioning member pivotable every time the paper sheet is discharged onto the receptacle for positioning the paper sheet. The receptacle has a paper receiving surface having either one of a recess or a notch, the positioning member having a pushing portion which is movable through the recess or the notch for pushing the paper sheet.

Further, a paper positioning device of the present invention comprises a receptacle having a paper receiving surface for stacking a paper sheet discharged through a paper discharging section, the paper receiving surface being sequentially inclined upward from an upstream side to a downstream side with respect to an intended direction of paper discharge, a paper positioning member for positioning the paper sheet every time the paper sheet is discharged onto the receptacle, and a stop member extending upward from and substantialy perpendicularly to the paper receiving surface of the receptacle for receiving and positioning a trailing edge of the paper sheet discharged onto the receptacle.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
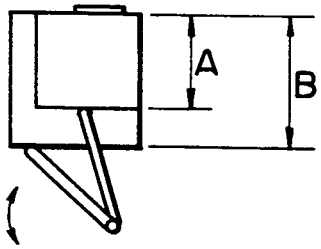
Fig. 1 PRIOR ART
FIG. 1 is a plan view of a prior art paper positioning device.

To better understand the present invention, a brief reference will be made to a prior art paper positioning device, shown in FIG. 1. The device shown in FIG. 1 is of the type having a capability for selectively positioning paper sheets of different sizes, as taught in previously mentioned U.S. Pat. No. 3,910,568. As shown, the prior art device has a paper positioning member which is pivotable by a variable angle in matching relation to the paper size. Specifically, the pivoting angle is increased for comparatively small paper sizes and decreased for compatively large paper sizes. However, the position at which the paper positioning member abuts against paper sheets changes from one paper size to another, so that the positioning accuracy is lowered depending on the paper size.

Figure 2:
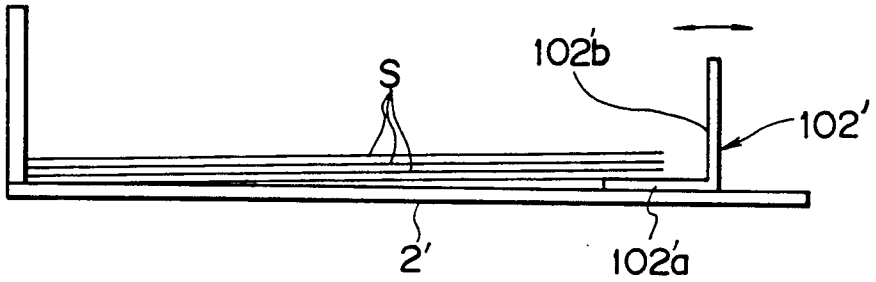
Fig. 2 PRIOR ART
FIG. 2 is a side elevation illustrating a drawback particular to the prior art device of FIG. 1.

Generally, a paper positioning device is built not only in a sorter which is operable with an image forming apparatus but also a finisher and an intermediate tray of a copier having a two-side copying function, etc. As shown in FIG. 2, the device for such an application has a table 2' having a flat surface, and a pivotable plate 102' positioned on the table 2' and pivotable as indicated by an arrow in the figure. Every time a paper sheet S is introduced into the device such that it extends over a horizontal portion 102'*a* of the plate 102' and the table 2', the plate 102' is moved toward the edge of the paper sheet S in a pivoting motion to position the paper sheet. The paper sheet S is laid not only on the table 2' but also on the horizontal portion 102'*a* of the plate 102' as mentioned above, so that a pushing portion 102'*b* of the plate 102' may surely abut against the edge of the paper sheet S. However, the paper sheet S, especially the paper sheet laid on the table 2' first, is apt to get into between the table 2' and the horizontal portion 102'*a* of the plate 102'. Then, the plate 102' will miss the edge of the paper sheet S when rotated for positioning purpose.

Figure 3:
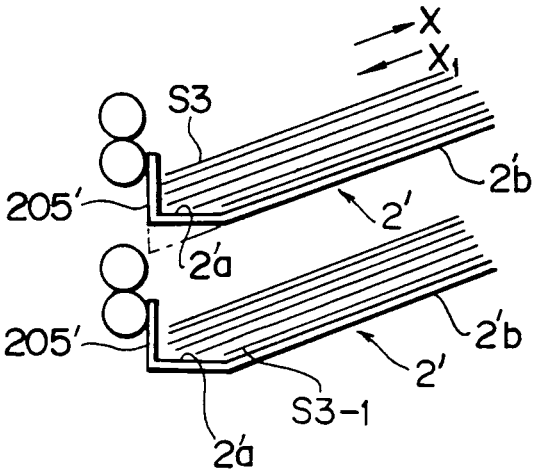
Fig. 3 PRIOR ART
FIG. 3 is a side elevation illustrating a drawback particular to an upright wall configuration of a prior art bin.

Regarding a receptacle, it is a common practice to incline it for positioning the trailing edge of a paper sheet. Specifically, when a paper sheet is discharged onto the inclined receptacle, it slides downward and rearward along the receptacle by gravity until it has been received by a receiving portion which is located at the rear end of the receptacle. FIG. 3 shows a specific configuration of the prior art receptacle which is implemented as a bin of a sorter. As shown, a number of bins each having a paper receiving surface are arranged one above another for receiving paper sheets S which are discharged as indicated by an arrow X. Each bin 2' is inclined upward along the intended direction of paper discharge X. The paper sheet reaching the bin 2' is positioned by a paper positioning device, not shown. At the same time, it drops rearward due to the inclination of the bin in a direction indicated by an arrow X1 by gravity. The rear edge S3 of the paper sheet is received by a receiving portion 205' which is provided at the rear end of the bin 2'. As shown in FIG. 3, the rear end configuration of the prior art bin 2' is such that a flat paper stacking surface 2'*a* adjoins the receiving portion 205' and makes an obtuse angle relative to the other paper stacking surface 2'*b*. Hence, despite the operation of the paper positioning device or the gravity urging the paper sheet S toward the receiving portion 205' of the bin 2', the trailing edge S3-1 of the paper sheet, especially that of the first paper sheet, is apt to fail to abut against the receiving portion 205' and is not positioned with accuracy. The flat paper stacking surface 2'*a* is adopted to provide a spacing great enough to insure the entry of paper sheets between nearby bins 2' at the rear end of the latter. Should the rear end of the bin 2' be configured as indicated by a phantom line in FIG. 3, the spacing between nearby bins 2' would be reduced. However, even if the bin 2' is configured as indicated by the phantom line, the rear edge S3 of the paper sheet is inclined relative to the top of the paper stack. Stapling or otherwise finishing such a paper stack is undesirable when it comes to binding quality.

Figure 4:
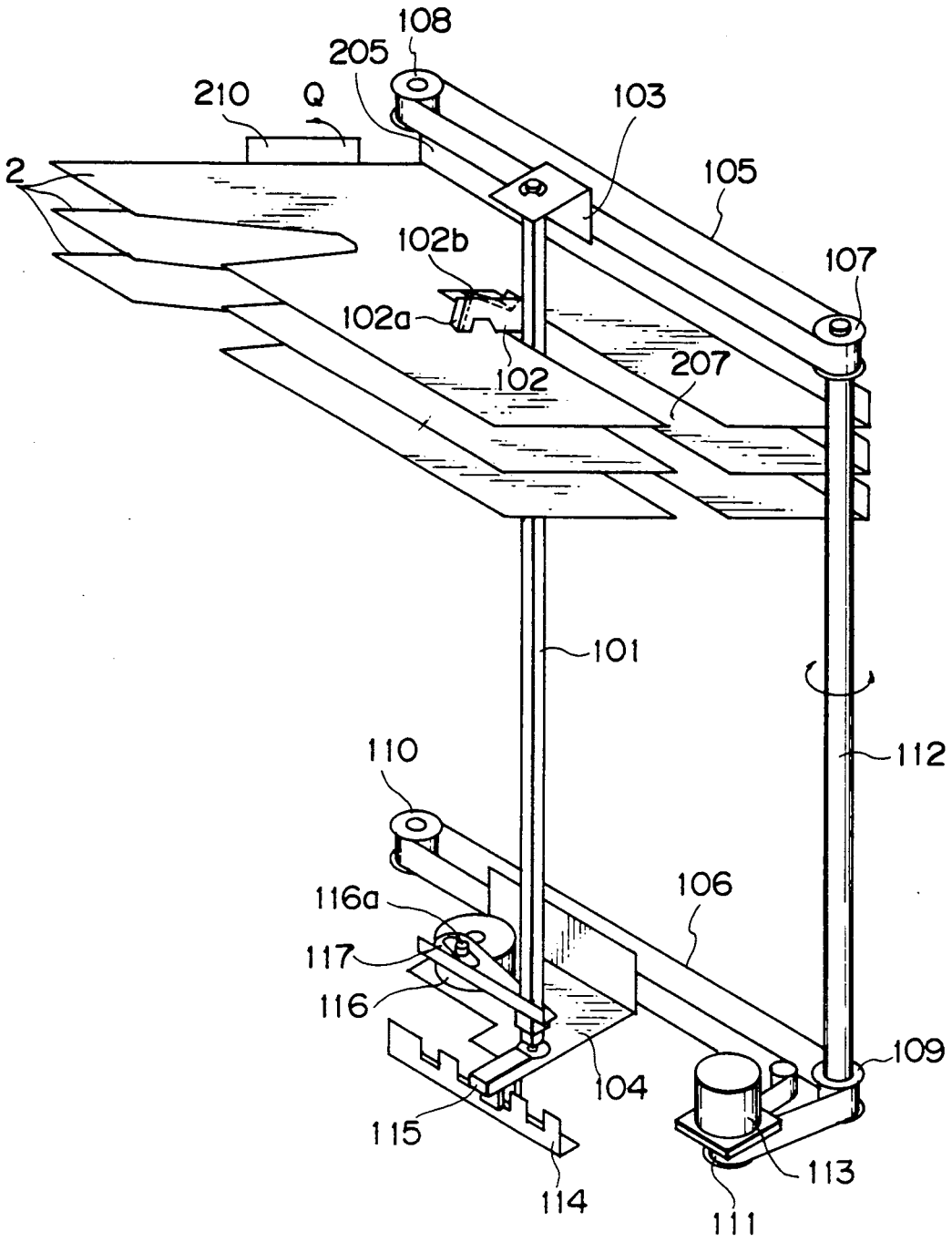
FIG. 4 is a perspective view of a paper positioning device embodying the present invention.
Figure 5:
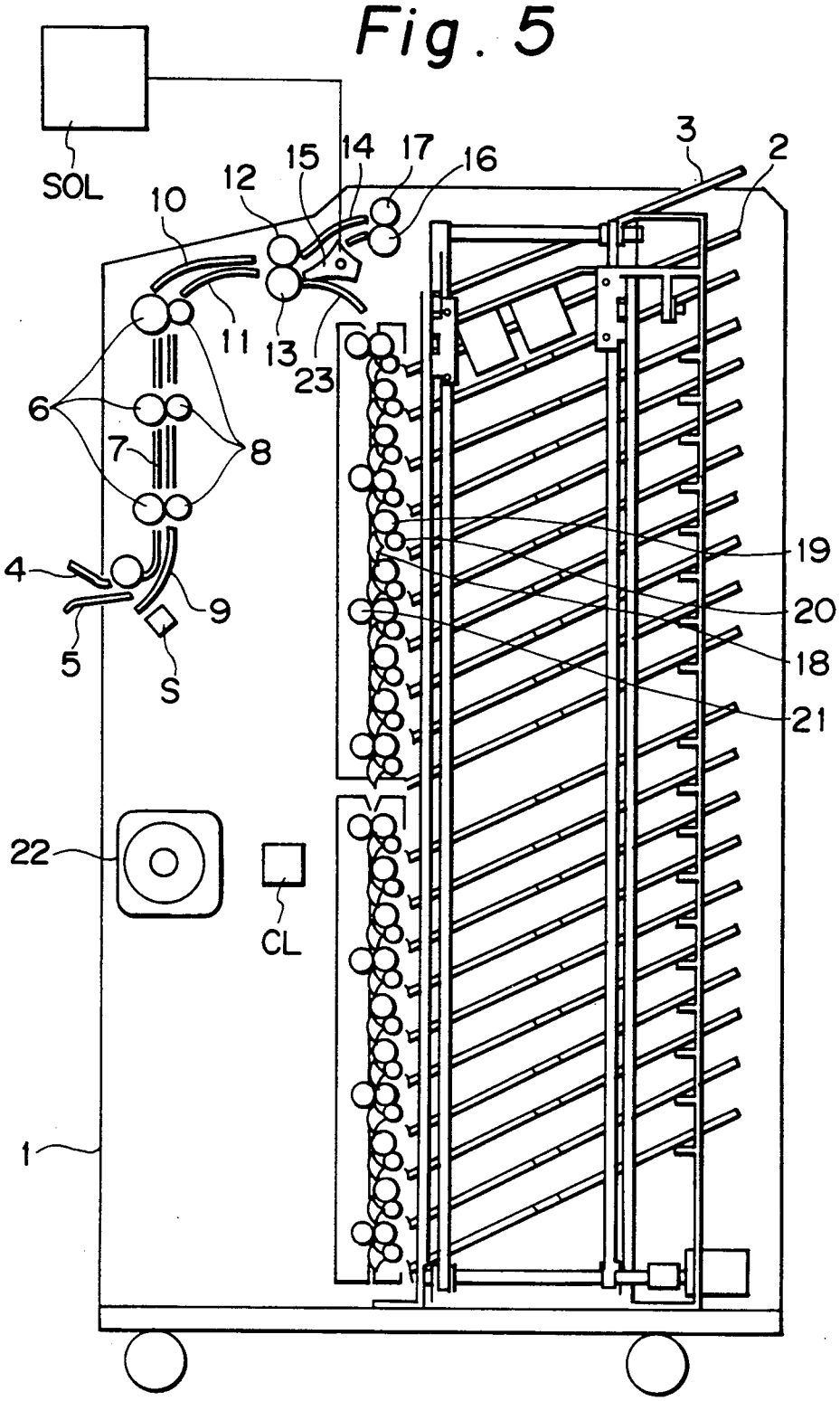
FIG. 5 is a sectional side elevation of a sorter to which the present invention is applicable.

Referring to FIG. 4, a paper positioning device embodying the present invention is shown, particularly its general construction and relationship to bins. In the illustrative embodiment, the device is mounted on a sorter 1 of a copier which is shown in FIG. 5. When a copy driven out of a copier and representative of a family of paper sheets is distributed to any one of bins 2, the paper positioning device manipulates the paper sheet to a predetermined position. Subsequently, the sorter chucks the paper stack, moves it to a stapling position, and then staples it. The following description will begin with the overall construction of the sorter 1 which includes the illustrative embodiment of the present invention.

Referring to FIG. 5, the sorter 1 has inlet guides 4 and 5 located at an inlet for receiving copy sheets which are sequentially driven out of a copier, not shown. Guides 7, 9, 10 and 11, transport rollers 6, 8, 12 and 13, and a selector in the form of a pawl 15 are arranged downstream of the inlet guides 4 and 5 for transporting the incoming copy sheets upward. The selector 15 is movable to select either one of two independent paths, i.e., an upper path extending from a guide 14 to a discharge tray 3 via discharge a roller pair 16 and 17 and a lower path extending from a guide 23 to merge into a vertical transport path. The vertical transport path extends along the inlet ends of a plurality of, twenty in the illustrative embodiment, bins 2. The bins 2 are arranged one above another and in parallel to each other, and they are individually inclined obliquely upward, as illustrated. On the vertical transport path, a deflector in the form of a pawl 18, a transport roller 19 and a discharge roller 20 are provided and associated with each of the bins 2. The transport roller 19 and discharge roller 20 are provided in a pair. Driven rollers 21 are pressed against some of the transport rollers 19 which are spaced apart from each other by a suitable distance. The transport rollers 6, 8, 12 and 13, discharge rollers 16 and 17, transport rollers 19 and discharge rollers 20 are driven by a drive motor 22.

Figure 6:
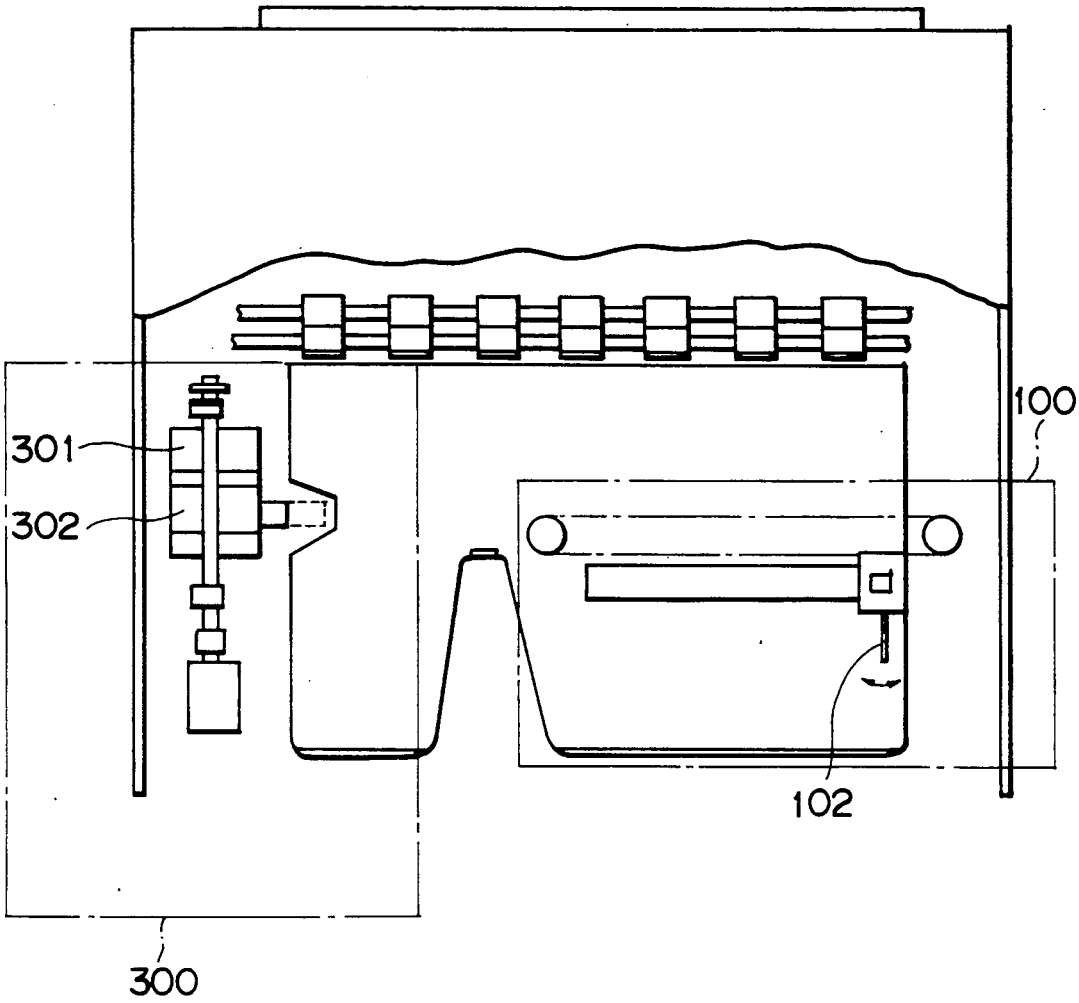
FIG. 6 is a plan view of the sorter shown in FIG. 5.

As shown in FIG. 6, a stapling or binding device 300 is located at one side of the group of bins 2. The stapling device 300 is made up of a stapler 301 for stapling a paper stack, a chucking unit 302 for pulling a stack of paper sheets toward the stapler 301, and a mechanism for moving the stapler 301 and chucking unit 302 up and down to any one of the bins 2. Located at the other side of the group of bins 2 is a paper positioning device 100 which has a unit for positioning a paper sheet before the latter is stapled, and a device for moving such a unit to a position matching a paper size.

Figure 7:
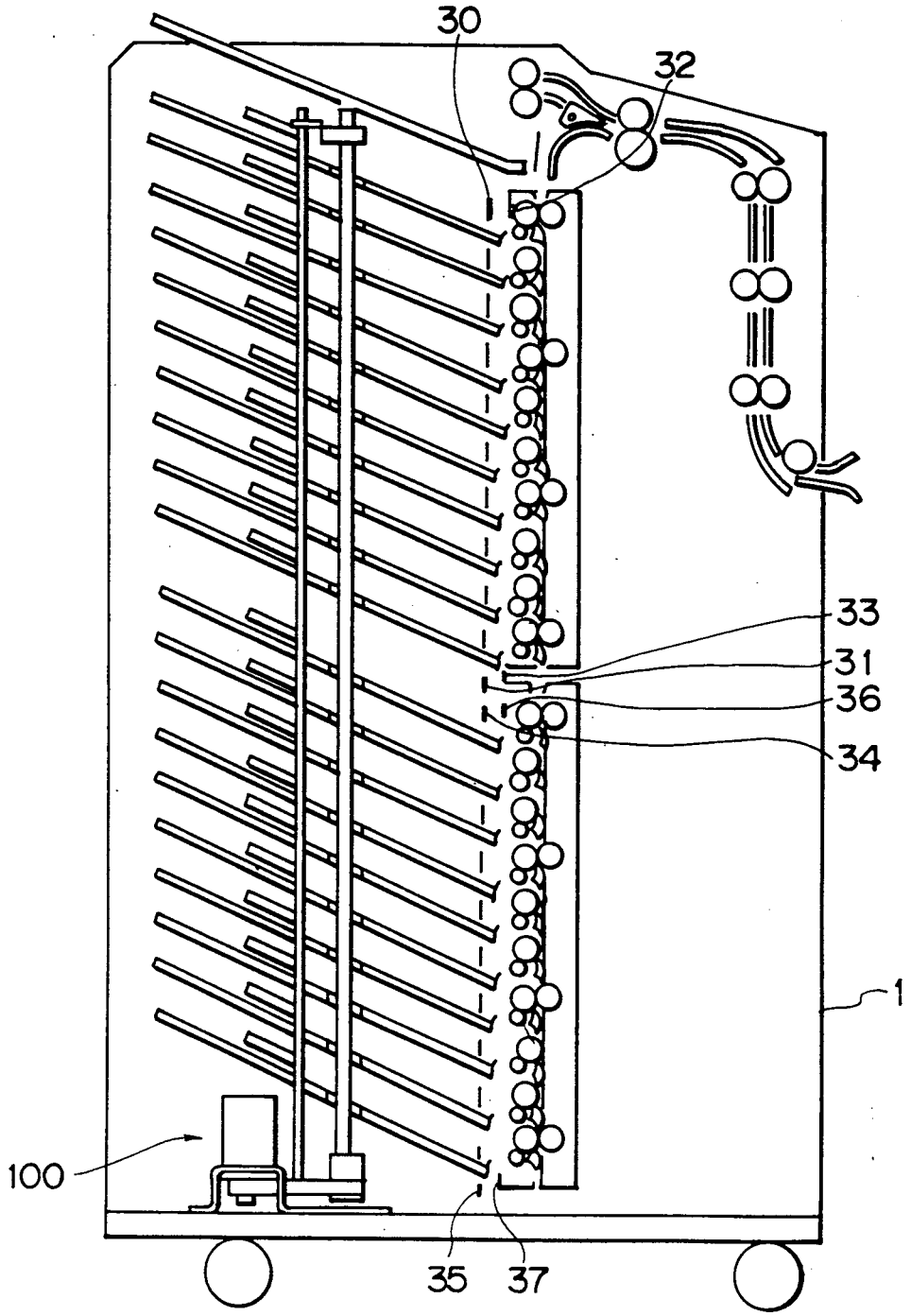
FIG. 7 is a sectional side elevation of the sorter as seen from the right in FIG. 6.

FIG. 7 is a rear view of the apparatus shown in FIG. 5. The twenty bins are divided into a first block and a second block, each having ten bins. Bin sensors 30 and 31 and discharge sensors 32 and 33 are associated with the upper block, while bin sensors 34 and 35 and discharge sensors 36 and 37 are associated with the lower block. These sensors are each implemented as a transmission type photosensor which is composed of a light emitting diode and a phototransistor. The discharge sensors are each responsive to the discharge of a paper sheet or copy, while the bin sensors are each responsive to a copy in the associated bin. With the bin sensors, it is possible to use the lower block if the upper block is loaded with copies.

Referring again to FIG. 5, a copy driven out of a copier enters the sorter via the inlet guides 4 and 5 and is transported upward by the guides and transport rollers. In an ordinary discharge mode, the selector 15 is lowered to steer the copy toward the discharge tray 3 via the guide 14 and discharge roller pair. In a sort mode (sorting copies in order of page) or a stack mode (sorting copies page by page), the selector 15 is raised to steer the copy upward along the guide 23. The copy driven by the transport rollers 19 and driven rollers 21 is distributed to a particular bin 2 where the associated deflector 18 is held in an operative position. The deflectors 18 are moved in matching relation to the mode (sort mode or stack mode).

In the sort mode, the deflector 18 associated with the first bin 2 is actuated to discharge the first coy of the first document page the first bin 2. The second copy of the first page is discharged to the second bin 2 by the deflector 18 associated with the second bin 2. The first copy of the second page is distributed to the first bin 2, and the second copy of the second page is distributed to the second bin 2. In this manner, in the sort mode, the first page and successive pages are sequentially distributed to each bin 2. In the stack mode, all the copies of the first page are discharged to the first bin, while all the copies of the second page are discharged to the second bin.

In order that the copies sorted in any one of the above-described modes may be stapled, it is necessary that the stack of copies on each bin be neatly arranged. To meet this requirement, the sorter is provided with the paper positioning device of the present invention. The construction of the paper positioning device will be described with reference mainly to FIG. 4.

Each bin 2 has an upright bin fence 210 at one edge thereof and serves to receive one edge of paper sheets. The bin fence 210 is a specific form of a first stop member. A rear end upright portion 205 extends upward from another edge of the bin 2 which is perpendicular to the edge where the bin fence 210 is located. The upright portion 205 also serves as a stop member and is a specific form of a second stop member. A notched portion 207 extends from the edge of the bin 2 which is parallel to the edge where the bin fence 210 is located. The notched portion 207 extends over a predetermined length toward the bin fence 210. A main shaft 101 has a rectangular cross-section and extends upright throughout the notched portions 207 of the bins 2. The main shaft 101 is a specific form of a rotatable shaft. A plurality of pushing members or pushers 102 are mounted on the shaft 101 at spaced locations each corresponding to respective one of the bins 2. The pushers 102 are an example of paper positioning members. Specifically, each pusher 102 abuts against the end of a stack of paper sheets for positioning purpose. Each pusher 102 may be constituted by a single member. In the illustrative embodiment, however, the pusher 102 is made of metal or synthetic resin, for example, and has an elastic pushing piece **102*a* and an auxiliary elastic pushing piece 102*b*. The pushing piece 102*a* is fitted on the free end of the pusher 102 remote from the main shaft 101, while the auxiliary pushing piece 102*b* is fitted on an upper end portion of the pusher 102. Both the pushing pieces 102*a* and 102*b* are positioned to face the bin fence 210. The pushing pieces 102*a* and 102*b* are made of a spring material, polyester film or similar elastic material. The auxiliary pushing member 102*b* faces the surface of the bin 2** on which a copy is to be laid.

Figure 9:
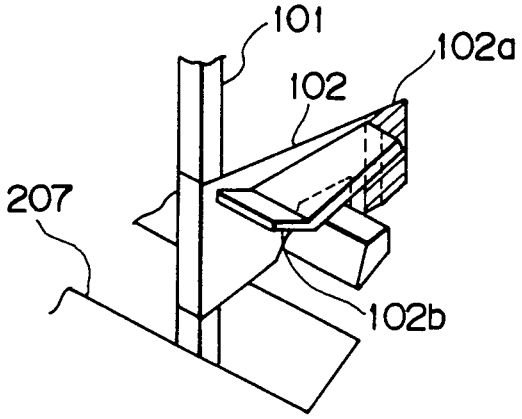
FIG. 9 is a fragmentary perspective view of the device shown in FIG. 4.

When the pusher 102 is pivotally moved to urge the end of a paper stack for positioning the latter, the pushing piece **102*a* is elastically deformed to provide the paper stack with elasticity. This allows a force to act uniformly on the paper stack despite any scattering in the mounting position of the pusher 102, bin 2, and bin fence 210. When the paper sheet is curled upward away from the bin 2, the auxiliary elastic member 102*b* presses it so that the pusher 102 surely abuts against the end of a paper stack. Should the elastic member 102*b* be absent, the end of the paper stack would slide on the pusher 102 when urged by the pusher 102 or the elastic pushing member 102*a* and would thereby fail to assume an accurate position. In the illustrative embodiment, the auxiliary pushing member 102*b* extends out from the pusher 102 perpendicularly to the latter and has a generally V-shaped configuration, i.e., its lower portion is bent downward (FIG. 9). More specifically, a portion of the pushing member 102*b* that receives a paper sheet first is sequentially lowered as viewed in an intended direction of paper entry. With such a configuration, the pushing member 102*b* surely abuts against the end of a paper stack even when the paper stack is curved upward, by surely guiding it onto the bin 2** while pressing the curl.

The main shaft 101 carrying the pushers 102 thereon is moved by moving means to a position matching a paper size along the notch 207. Generally L-shaped brackets 103 and 104 are respectively mounted on the upper end and the lower end of the main shaft 101. Toothed belts 105 and 106 are respectively disposed in an upper region and a lower region of the bins 2, and each extends substantially in the same direction as the notched portions 207. The brackets 103 and 104 are anchored to the toothed belts 105 and 106, respectively. The toothed belt 105 is passed over pulleys 107 and 108, while the toothed belt 106 is passed over pulleys 109, 110 and 111. The pulleys 107 and 109 which are drive pulleys are respectively mounted on the upper end and the lower end of an upright drive shaft 112. The pulley 111 is mounted on the output shaft of a size shift motor 113. The moving means is composed of the size shift motor 113, pulleys 107 to 111, toothed belts 105 and 106, drive shaft 112, etc.

Figure 10:
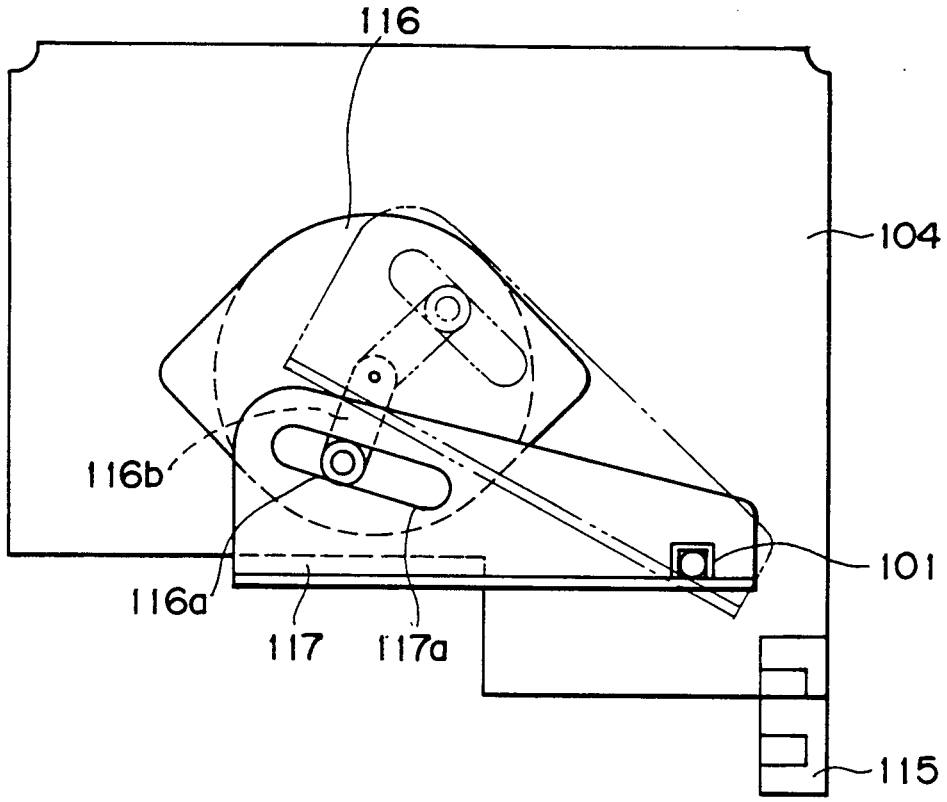
FIG. 10 is a plan view of a drive arrangement which forms another essential part of the device shown in FIG. 4.
Figure 11:
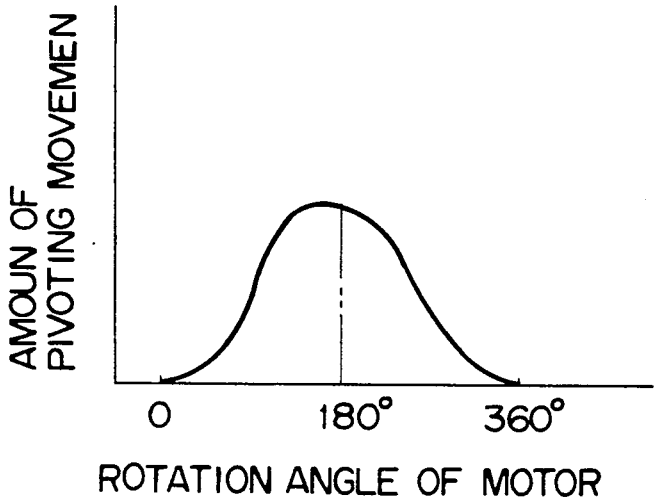
FIGS. 11 and 12 are graphs demonstrating the operation of the drive arrangement shown in FIG. 10.

A position sensing plate 114 and a position sensor 115 constitute a specific form of position sensing means and cooperate to sense a position of the pusher 102. The position sensing plate 114 is mounted on the sorter, while the position sensor 115 is mounted on the lower bracket 104. As shown in FIG. 10, a pivot motor 116 and other components of driving means are mounted on the lower bracket 104 for causing the pusher 102 into a pivoting motion. The pusher 102 pivots at the lowest speed at a positioning position indicated by a phantom line in FIG. 8 and moves at a higher speed from a solid line position to the phantom line position. While such a pivoting characteristic is obtainable by controlling the rotation of the pivot motor 116, the illustrative embodiment achieves it by using a crank mechanism. Specifically, in FIGS. 4 and 10, an arm **116*b* which is a specific form of a connecting member is rigidly mounted on the output shaft of the pivot motor 116. An eccentric shaft 116*a* which also forms part of the connecting member extends upward from the arm 116*b*. A pivot arm 117 extends out from the lower end of the main shaft 101 toward the motor 116. The eccentric shaft 116*a* is loosely fitted in an elongate slot 117*a* which is formed through the pivot arm 117. When the motor 116 is rotated, the arm 117 is rotated to in turn rotate the main shaft 101. The main shaft 101, therefore, rotates the elastic pushing members 102 of the individual pushers 102 between the two different positions. This rotation occurs as indicated by a curve in FIG. 8. The rotating speed is lowest at substantially the top dead center where paper sheets are regulated and is lowered in the intermediate portion. Such a crank mechanism, therefore, varies the rotating speed as shown in FIG. 11** without resorting to complicated control, whereby paper sheets are positioned efficiently and accurately.

The phantom line position of the elastic member 102*a* is selected such that the member 102*a* bites into the edge of a paper stack by a predetermined amount in order to surely urge the paper stack against the bin fence 210. Specifically, the pivoting angle is selected such that the distance between the resilient member 102 having been rotated and the bin fence 210 is smaller than the widthwise dimension of paper sheets to be positioned. However, if the above-mentioned distance is too short, it is likely that when the pusher 102 and elastic member 102*a* are retracted, the paper sheets spring back away from the bin fence 210 due to their own elasticity and are thereby brought out of neat arrangement. It is, therefore, necessary to select an adequate amount of bite of the elastic member into a paper stack. Especially, the bite should be prevented from becoming excessive when the elastic member 102*a* is absent. Experiments showed that regarding plain paper sheets for use with a copier, an amount of bite less than 10 millimeters does not disturb a neat stack of five to fifty paper sheets.

The operation of the paper positioning device will be described.

As stated above, in the illustrative embodiment, the pivoting section has the pushers 102, main shaft 101, pivot arm 117, motor 116 and other components thereof constructed into a unit and is bodily moved by the size shift motor 113 to a position matching the size of paper sheets. When a size signal is fed from the copier, the size shift motor 113 rotates the upper and lower toothed belts 105 and 106. As a result, the pushers 102 mounted on the main shaft 101 are moved forward toward one end of paper stacks loaded on the individual bins 2. The pivoting unit is stopped at a predetermined position associated with the paper size as sensed by the position sensing plate 114 and position sensor 115. As a result, the pusher 102 is pivotable at a position adequate for a particular paper size to thereby position paper sheets with accuracy. In this particular embodiment, an arrangement is made such that when the size sensor 115 determines that the pivoting unit has reached a stop position just before a stop position associated with the paper size of interest, the size shift motor 113 is switched from a high speed to a low speed, as will be described in detail later with reference to FIG. 19. This switchover of the motor speed is successful in stopping the pivoting unit at a predetermined position accurately, further enhancing accurate paper positioning.

The pivoting movement of the pusher 102 occurs at a predetermined timing after the discharge of a copy onto the bin 2 by taking account of the timing at which the copy discharged onto the bin 2 drops along the slant of the bin 2. In the illustrative embodiment, assuming that the inclination of the bin 2 is 25 degrees, the pusher 102 is caused into a pivoting motion on the lapse of 300 milliseconds after the discharge sensors 32 and 33 or 36 and 37 have sensed the end of discharge of a copy sheet. More specifically, the pusher 102 is rotated after a copy sheet discharged onto the bin 2 has dropped into abutment against the rear upright portion 205 of the bin 2, whereby the copy sheet is surely positioned in the direction perpendicular to the intended direction of paper discharge and in the intended direction of paper discharge. It was found by experiments that the period of time of 300 milliseconds is a desirable timing for the pivoting motion. It is to be noted that this period of time depends on the kind of paper sheets used and may be further shortened, if necessary, in order to promote efficient reproduction in relation to the copying time. The pivoting timing will be described later in detail with reference to FIG. 20.

Figure 12:
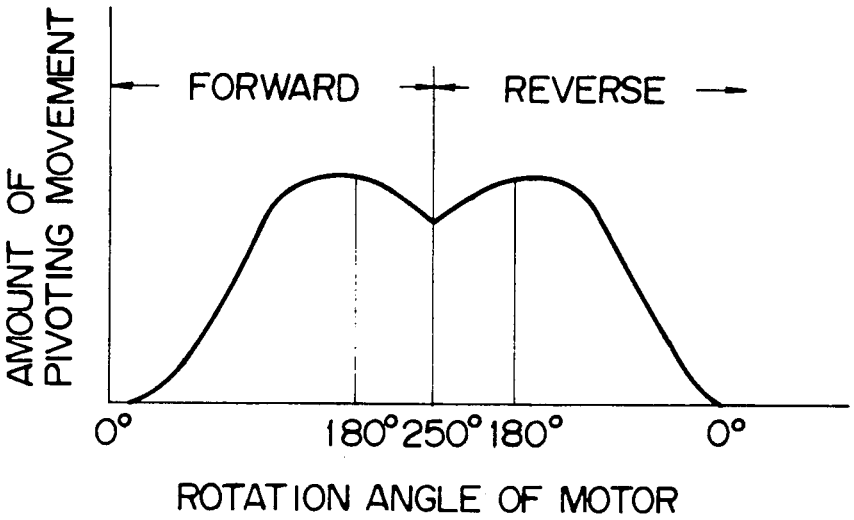

At the pivoting timing, the pivot motor 116 may perform substantially a half rotation (180 degrees) forward and then backward to its home position. This will cause the arm 117 to pivot once and imparts its angular movement to the individual pushers 102 via the main shaft 101. However, in the illustrative embodiment, the motor 116 is rotated by 250 degrees forward and then backward to the home position, as shown in FIG. 12. The angle of 250 degrees is an example of an angular position which brings the pusher 102 beyond the maximum pivot position. Hence, each pusher 102 is caused to pivot twice by one step.

As the elastic member 102*a* of each pusher 102 abuts against one end of a paper stack loaded on the associated bin 2, the opposite end of the paper stack is urged against the bin fence 210. The pusher, therefore, moves the paper stack from the initial position indicated by a solid line in FIG. 8 to a position where the opposite end abuts against the bin fence 210 as indicated by a phantom line. This positions one end of the paper stack. The paper stack is positioned in the intended direction of discharge by gravity, as stated previously. In the illustrative embodiment, for more positive positioning, the resilient member 102*a* is pivoted as indicated by an arrow A in FIG. 8 to urge one end of the paper stack in the direction A such that another end perpendicular to the above-mentioned end is pressed against the upright portion 205 of the bin 2 and thereby positioned. Since the pivotal movement is implemented by the forward and backward rotations of the motor 116, the return to the home position is easy even when the pusher 102 has failed to fully push the paper stack during the forward movement.

Figure 8:
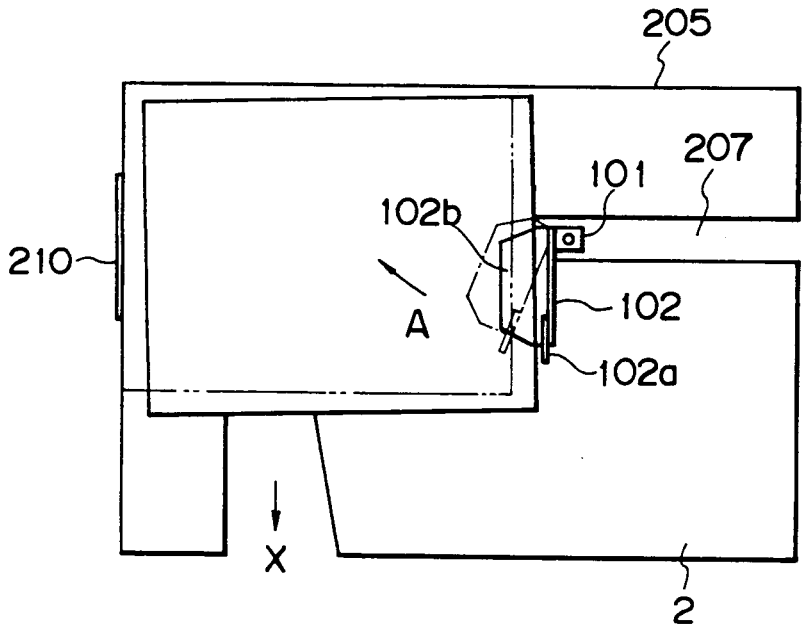
FIG. 8 is a plan view showing a specific configuration of a receptacle for receiving paper sheets.

The paper stack positioned on the bin 2 as described above is subjected to a stapling operation or similar finishing operation and then pulled out in a direction indicated by an arrow X in FIG. 8. Since no obstructions exist in the direction X, the paper stack can be drawn out with ease.

Figure 13A:
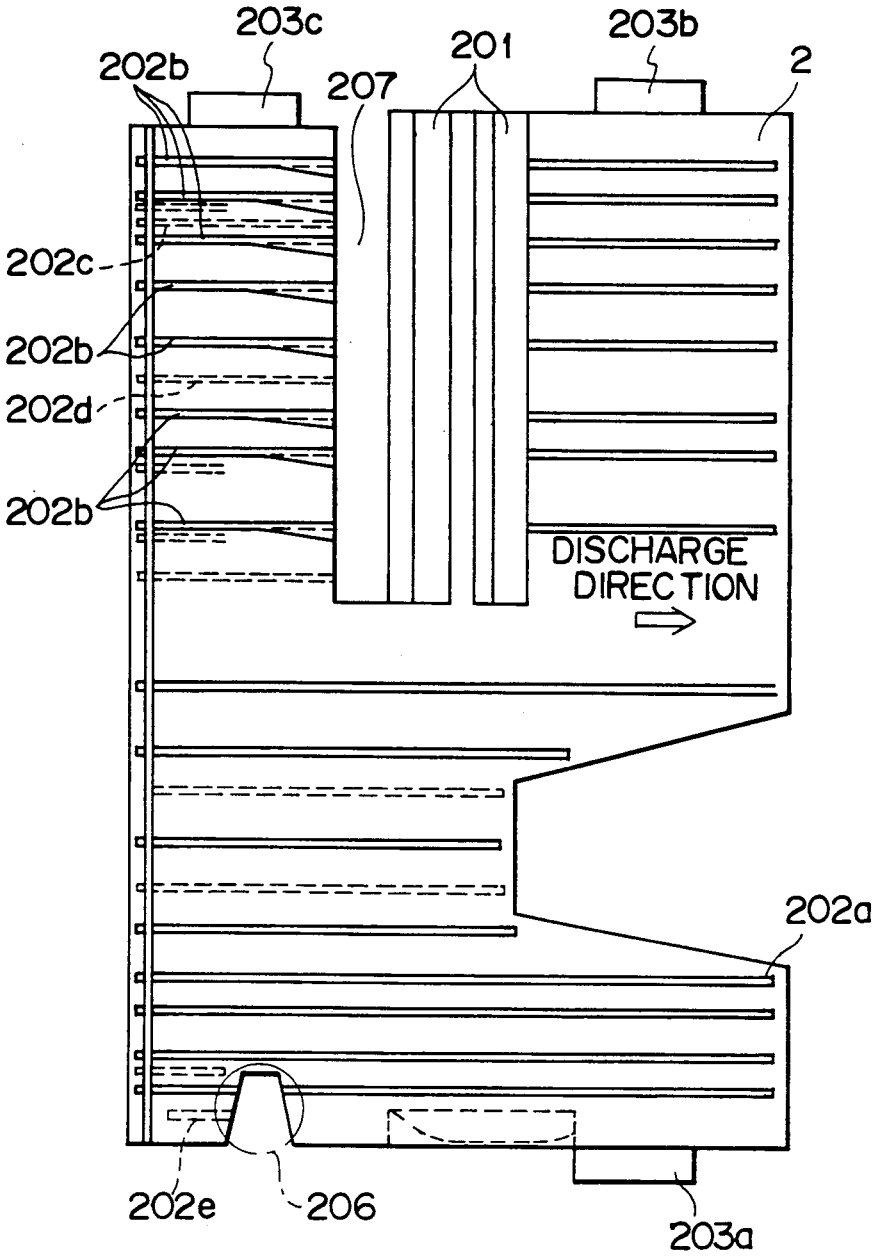
FIGS. 13A to 13C are views showing the receptacle in detail.
Figure 13B:
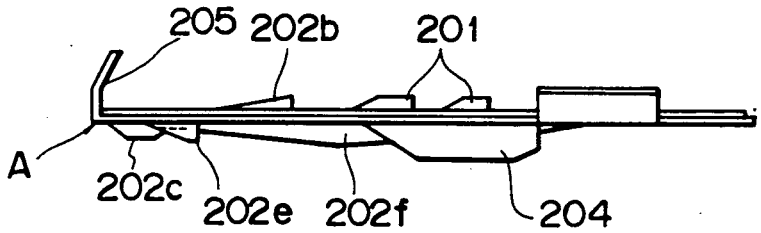
Figure 14A:
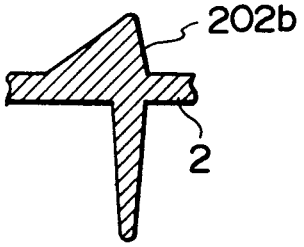
FIGS. 14A to 14P are views showing different conditions in which paper sheets are discharged onto a receptacle.
Figure 14B:
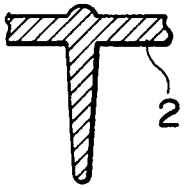
Figure 14C:
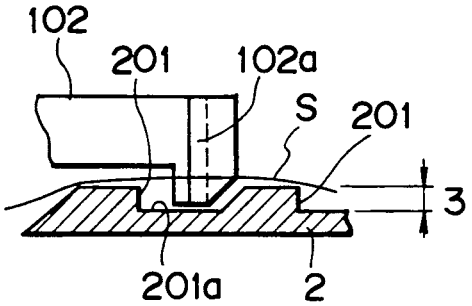

Referring to FIGS. 13A and 13B And 14A to 14P, the structure of the bin 2 contemplated to promote accurate positioning of a paper stack and accurate stapling will be described. FIGS. 13A and 13B are respectively a plan view and a side elevation of the bin 2. As shown in FIG. 13A, the notched portion 207 is positioned substantially at the intermediate of the bin 2 for allowing the main shaft 101 to move in matching relation to the paper size. Two ridges 201 are located beside the notched portion 207 and defines a channel 201*a* for receiving the pusher 102 and resilient member 102*a*, as also shown in FIG. 14C. More specifically, the tip of the pusher 102 extends downward with its elastic member 102*a* being positioned in the channel 201*a*. The channel 201*a* may be 3 millimeters deep, for example.

In the above configuration, when the pusher 102 is rotated to urge copy sheets S with its elastic member 102*a*, the elastic member 102*a* moves through the channel 201*a*. Hence, as FIG. 14C indicates, the elastic member 102*a* surely abuts against and urges the paper sheet S. The pusher 102, therefore, urges not only the first paper sheet S distributed to the bin 2 but also successive paper sheets to thereby surely position them. This prevents a paper sheet from getting into between a pivotable plate and associated bin to cause the plate to simply swing without touching the paper sheet, as discussed earlier.

Figure 14D:
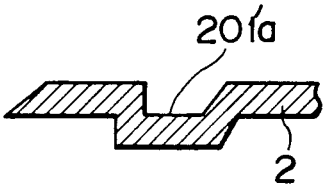

As shown in FIG. 14D, the channel 201*a* defined by two ridges 201 may be replaced with a simple recess 201'*a*. Nevertheless, the channel 201*a* is advantageous over the simple recess 201'*a* in that it raises the paper sheet S, as shown in FIG. 14C, and thereby more surely causes the resilient member 102*a* into abutment against the paper sheet S. Another advantage achievable with the ridges 201 is that the paper sheet S is provided with elasticity and, therefore, positioned with greater accuracy.

In the embodiment shown and described, the pushing portion of the pusher 102 moves through the channel 201*a* of the bin 2. Alternatively, the bin 2 may be formed with a notch in which the pushing portion is movable during pivotal movement.

Ribs 202*b* provided on the bin 2 prevent a paper sheet from slipping into the notched portion 207. Specifically, as shown in FIG. 14A, each rib 202*b* located in the vicinity of the notched potion 207 extends out upward and downward from the bin 2 so as to prevent a paper sheet from getting under the bin 2 and, at the same time, to prevent it from slipping into the notched portion of the overlying bin. Regarding the position of the ribs 202*b*, it is substantially 10 millimeters inwardly of the end of the paper size to guide, especially the end of a paper sheet which is apt to enter the notched portion 207.

As shown in FIG. 13A, the rib portion protruding upward from the bin 2 has a generally triangular gently-sloping cross-section. Such a configuration is successful in guiding a paper stack stapled and discharged such that it is not caught by the ribs 202*b*. Each rib 202*b* has a height which sequentially rises toward the notched portion 207, as will be understood from FIG. 13B. This is to accommodate a greater number of paper sheets on the bin 2.

Figure 14E:
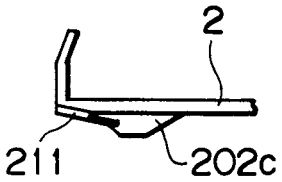

As shown in FIG. 14E, in the illustrative embodiment, a discharging brush 211 is mounted on the bin 2 for increasing the number of copies which can be loaded on the bin 2. It is likely, however, that the brush 211 catches a discharged paper sheet due to a curl of the latter or similar cause, effecting the stacking and positioning accuracy. Ribs 202*c* also provided on the bin 2 guide such a paper sheet to surely prevent it from being caught by the brush 211. These ribs 202*c* are also positioned in such a manner as to press opposite ends of various sizes of paper sheets.

Figure 14F:
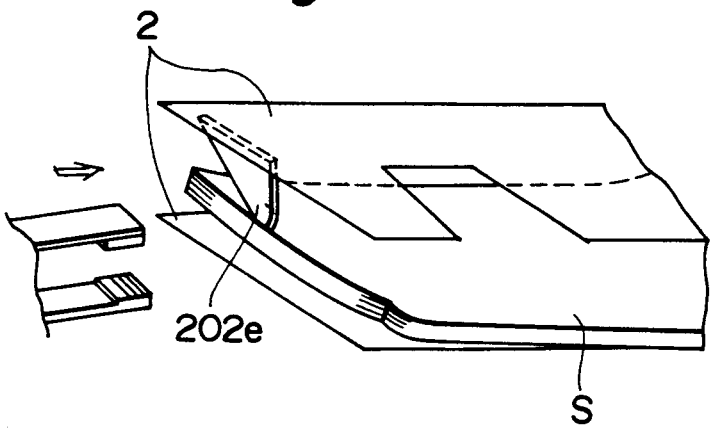
Figure 14G:
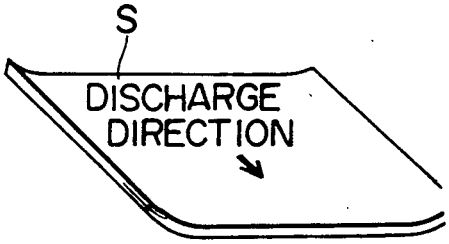

As shown in FIG. 13B, a rib 202*e* extends downward from the bin 2. As FIG. 14F indicates, the rib 202*e* serves to press the end of paper sheets. As shown in FIG. 14G, when paper sheets have a substantial curl, the chucking section is capable of surely chucking them without abutting against the end of the latter during its forward movement.

Figure 14H:
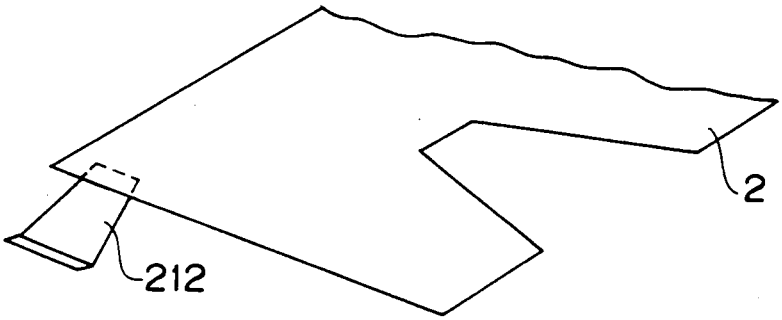
Figure 14I:
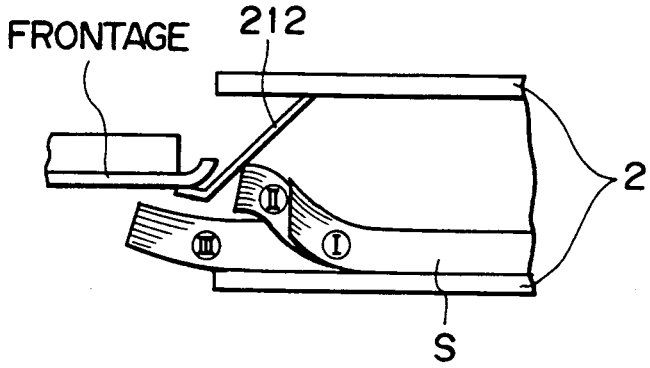
Figure 14J:
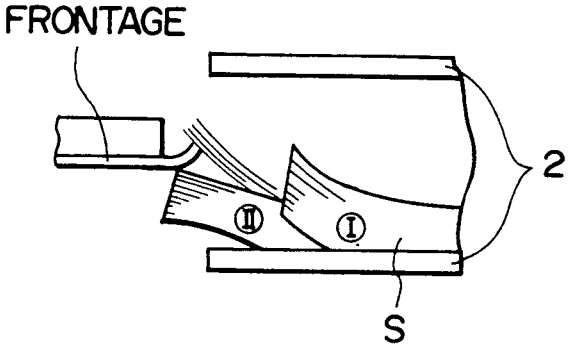

As shown in FIGS. 14H and 14I, a guide member 212 is affixed to the underside of the bin 2 adjacent to the stapler for guiding a paper stack loaded on the bin 2. Specifically, when the paper sheets are moved toward the stapler section by the chucking section, the guide member 212 causes them to surely enter a frontage of the stapler. As shown in FIG. 14J, if the guide member 212 is absent, there is a fear that the paper sheets P are caught by the frontage portion when moved from a position I to a position II. This is especially true when the paper sheets are noticeably curled or when a great number of paper sheets are loaded on the bin 2. As shown in FIG. 14I, the guide member 212 surely guides the paper sheets into the frontage of the stapler as represented by positions I, II and III.

Figure 14K:
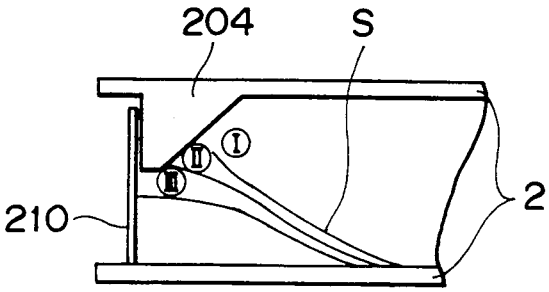
Figure 14L:
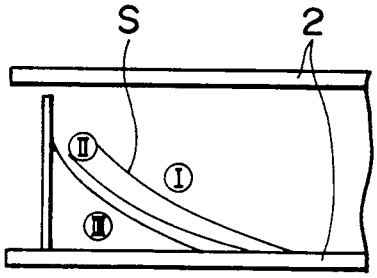

In FIG. 11, a projection 307 extends downward from the bin 204. While a paper sheet distributed to the bin 2 is positioned in one direction, it is apt to get over the bin fence 210 if it has a substantial curl. The projection 307 promotes accurate positioning of such a paper sheet by pressing the curl. FIGS. 14K and 14L show respectively a case wherein the projection 204 is present and a case wherein it is absent in order to illustrate the effect of the projection 204. In FIGS. 14K and 14L, the position of the paper sheet sequentially varies as indicated by I, II and III.

In FIG. 13A, the bin 2 is formed with a notch 206 for allowing the chucking section to chuck paper sheets stacked on the bin 2.

The bins 2 are mounted on the sorter in a certain angular position, e.g., at an angle of 25 degrees to the horizontal. In this configuration, paper sheets are positioned in the intended direction of discharge not only by the rotation of the pusher 102 but also by gravity.

Figure 14M:
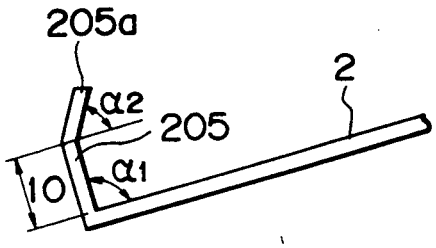
Figure 14N:
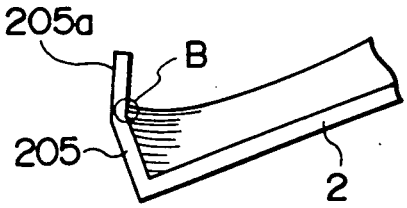
Figure 140:
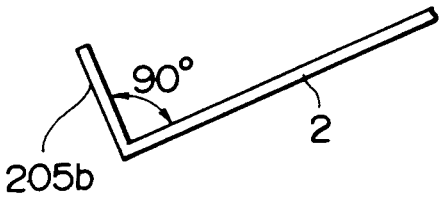

As shown in FIGS. 14M and 14N, the innermost or lowermost portion 205 of the bin 2 is provided with a unique configuration in order to enhance accurate positioning in the intended direction of discharge and to promote neat stacking. Specifically, a wall 205 extends from the lowermost portion 205 perpendicularly to the latter as indicated by an angle $\alpha 1$. When the rear edge of the paper sheets abut against the upright portion 205 of the bin 2 by gravity or under the action of the pusher 102, the wall 205 positions it accurately perpendicularly to the paper receiving surface of the bin 2, i.e., without causing it to incline or undulate. Furthermore, the wall 205 allows nearby bins 2 to be spaced apart from each other more than in the case indicated by the phantom line in FIG. 3.

Figure 14P:
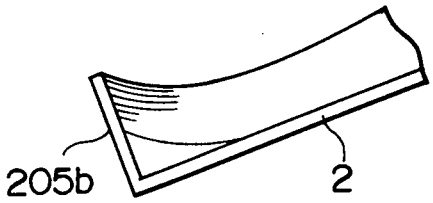

In the specific configuration shown in FIGS. 14M and 14N, the wall 205 of the bin 2 has an end portion 205*a* which is bent by an acute angle $\alpha 2$ smaller than 90 degrees relative to the bottom of the bin 2. When paper sheets S are sequentially stacked on the bin 2, a bend B of the above-mentioned wall 205 allows them to be accurately positioned and stacked by pressing curls. FIG. 14O shows a bin 2 the upright wall 205 of which is not provided with the bend B. The configuration shown in FIG. 14O fails to press curls of paper sheets and causes them to get over the wall 205*b*, as shown in FIG. 14P. Such an occurrence is apt to invite a paper jam.

Figure 13C:
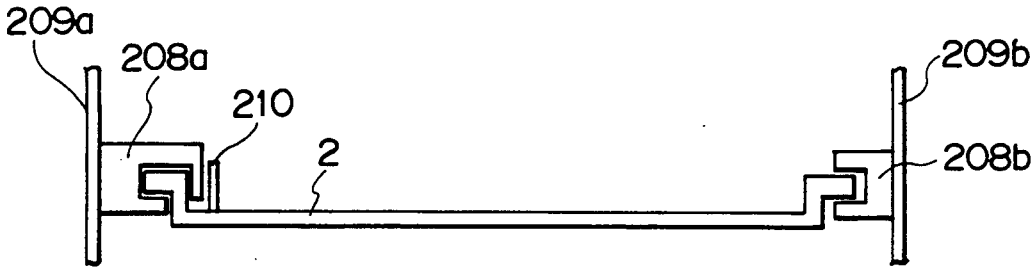

FIG. 13C is a side elevation of the bin 2 as seen from the right and shows how it is mounted. There are shown in the figure side walls 209*a* and 209*b* and bin supports 208*a* and 208*b*. The bin 2 is rigidly connected to the bin support 208*a* located near the bin fence 210 and is simply held by the other bin support 208*b* with a small clearance being defined between the bin 2 and the support 208*b*. The rigid connection of the bin 2 to the support 208*a* insures the accurate stapling position, while the clearance between the bin and the bin support 208*b* absorbs thermal expansion of the bin 2.

To facilitate an understanding of the present invention, a stapling device will be outlined hereinafter.

Figure 23:
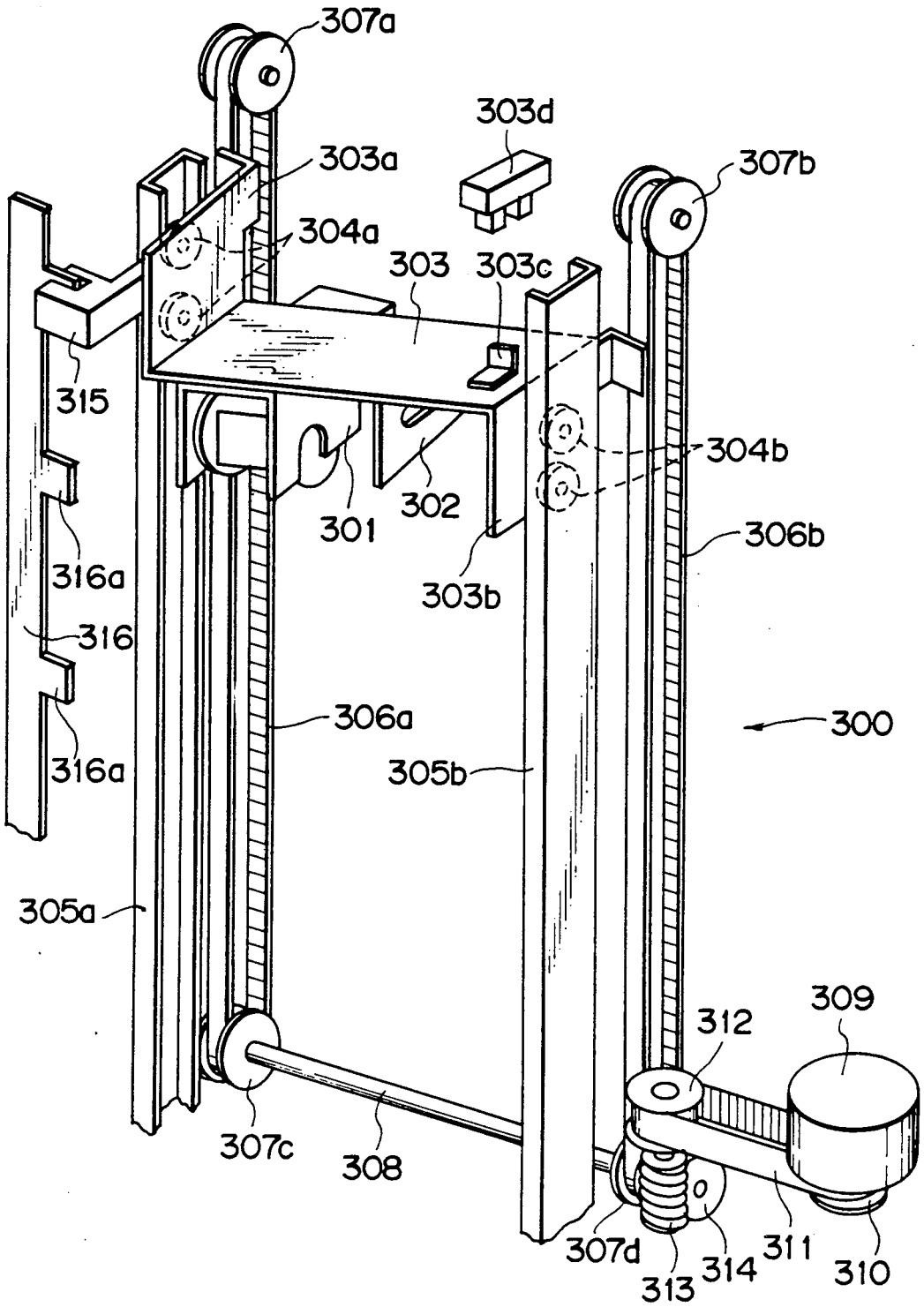
FIG. 23 is a perspective view of a stapling unit.
Figure 24:
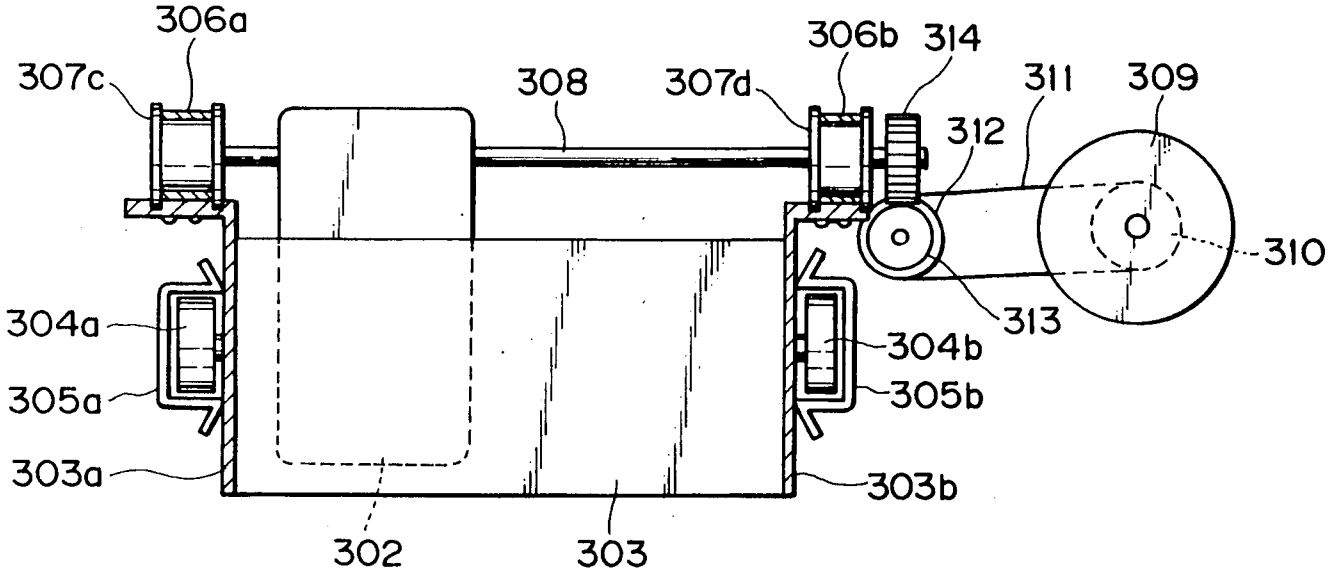
FIG. 24 is a fragmentary plan view of the stapling unit.

As shown in FIGS. 23 and 24, a stapling device 300 is located at one side of the multiple bins 2. The stapling device 300 has a stapler 301 and a chucking unit 302 which are mounted on the underside of a bracket 303. The stapler 301 drives a staple into a paper stack which is loaded on any one of the bins 2. The chucking unit 302 grips the paper stack on the bin 2 and transports it substantially in the horizontal direction.

Opposite ends 303*a* and 303*b* of the bracket 303 are bent upward and downward, respectively. Rollers 304*a* and 304*b* are rotatably mounted on the bent ends 303*a* and 303*b*, respectively. Two parallel guide rails 305*a* and 305*b* extend vertically along the ends of the bins 2. The rollers 304*a* and 304*b* are respectively received in the guide rails 305*a* and 305*b* so that the stapler 301 and chucking unit 302 are movable up and down integrally along the ends of the bins 2. A belt 306*a* is passed over pulleys 307*a* and 307*c* which are spaced apart from each other by a predetermined distance in the vertical direction. Likewise, a belt 306*b* is passed over pulleys 307*b* and 307*d* which are located in the same manner as the pulleys 307*a* and 307*c*. The belts 306*a* and 306*b* extend substantially parallel to each other along the bins 2. The bent ends 303*a* and 303*b* of the bracket 303 are respectively fastened to the belts 306*a* and 306*b* by screws. The lower pulleys 307*c* and 307*d* are mounted on a single shaft 308 to be rotatable integrally with each other. A pulley 310 is mounted on the output shaft of a motor 309. A belt 311 is passed over the pulley 310 and a pulley 312. A drive gear 313 is mounted on the same shaft as the pulley 312 and held in mesh with a gear 314. The rotation of the motor 309 is transmitted to the pulley 307*d* via such a gearing. In this configuration, the belts 306*a* and 306*b* are movable to transport the stapler 301 and chucking unit 302 up and down.

A position sensor 315 is mounted on the bent end 303*a* of the bracket 303, while an upright sensing plate 316 is associated with the position sensor 315, as illustrated. The sensing plate 316 has lugs 316*a* which are located at predetermined intervals in association with the bins 2. Such a position sensing mechanism allows the stapler 301 and chucking unit 302 to be brought to and stopped at any one of the bins 2. A lug 303*c* is provided on the bracket 303 and defines the upper limit position of the bracket 303 in cooperation with a sensor 303*d*. Specifically, when the lug 303*c* enters the sensor 303*d*, the motor 309 is deenergized to inhibit any further upward movement of the bracket 303.

Figure 25:
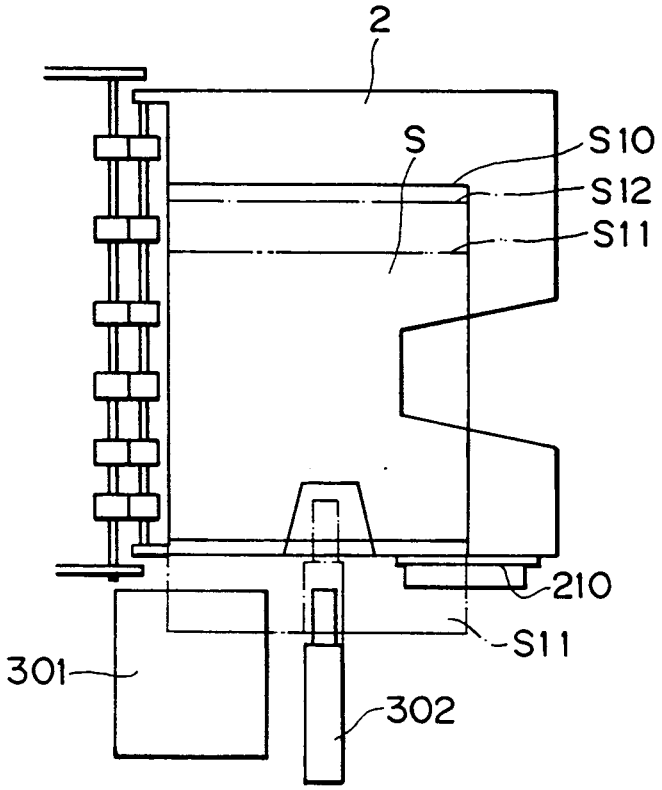
FIG. 25 is a plan view demonstrating how a paper stack is chucked and moved.

FIG. 25 is a view useful for understanding the movement of the stapling device 300. As shown, a paper sheet S distributed to the bin 2 is discharged in a position indicated by S10 and then urged by the previously stated paper positioning device against the bin fence 210. On the start of a stapling operation, the chucking unit 302 is moved from a solid line position to a phantom line position. At the phantom line position, a pair of chuck levers are closed to grip paper sheets. Then, the chucking unit 302 is returned to the solid line position, whereby the paper sheets are moved to a position S11. In this condition, the stapler 301 is driven to staple the paper sheets. Subsequently, the chuck levers are opened to release the stapled paper sheets, and a push bar which will be described pushes the paper sheets to return them to a position lying in the range of S12 and S10. Such a sequence of steps is repeated with the other bins.

Figure 26:
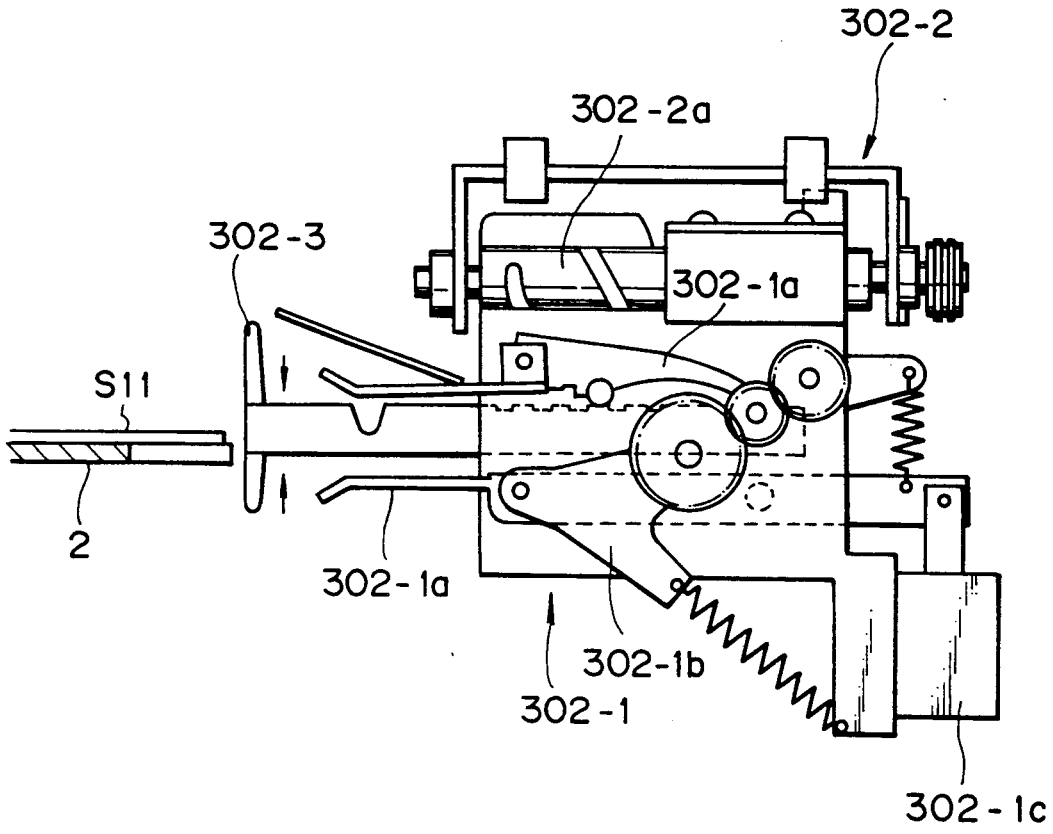
FIG. 26 is a front view of a chucking unit.

As shown in FIG. 26, the chucking unit 302 has a chuck section 302-1 for gripping a paper stack, a reciprocating mechanism 302-2 for moving the chuck section 302-1 horizontally in a reciprocating motion, and a push bar 302-3 for returning the stapled paper stack S11 to the bin 2. The chuck section 302-1 has a pair of rotatable arms 302-1*a* and 302-1*b*. Actuated by a solenoid 302-1*c*, the arms 302-1*a* and 302-1*b* cause their associated chucks levers 302-1*a* to grip a paper stack. The reciprocating mechanism 302-2 has a feed shaft 302-2*a* for moving the chuck section 302-1 toward and away from the bin.

Figure 27:
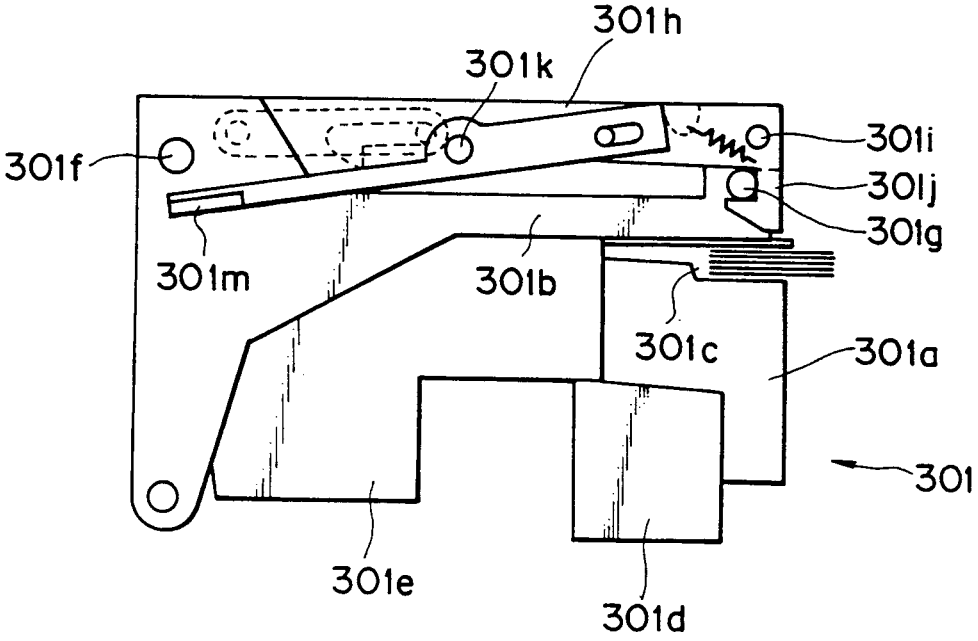
FIG. 27 is a view of a stapler.
Figure 28:
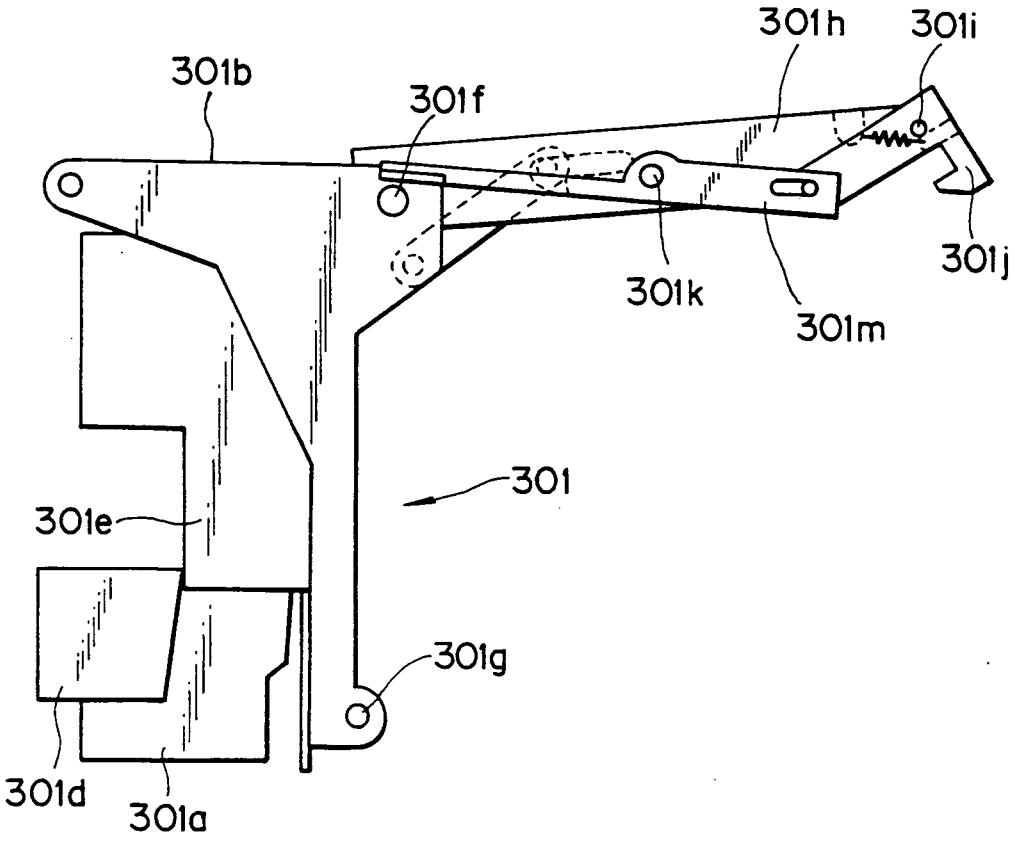
FIG. 28 is a view showing the stapler in a rotated position.

FIG. 27 schematically shows the structure of the stapler 301. In the illustrative embodiment, the stapler 301 is sustained upside down because a copier body, not shown, has a paper reversing device and drives copies face down thereoutof. Specifically, as shown in FIGS. 23 and 27, a staple member 301*a* loaded with staples is located below a staple member 301*b* which is adapted to receive the staple member 301*a*. A paper stack S is inserted in the frontage 301*c* defined between the staple members 301*b* and 301*c*. The lower staple member 301*a* is movable upward to drive a stapler into the paper stack S. The staple members 301*a* and 301*b* constitute the stapler 301 together with a body 301*e* and are integrally rotatably mounted on a shaft 301*f*. A stub 301*g* extends out from the staple member 301*b*. The stub 301*g* is retained by a release pawl 301*j* which is pivotally mounted on a shaft 301*i*, whereby the stapler 301 is locked to a base 301*h* which is mounted on the bracket 303 (FIG. 23). The release pawl is rotatable driven by a release lever 301*m* which is rotatably supported on a shaft 301*k*. When the release lever 301*m* is rotated clockwise as viewed in the figure, it is released from the stub 301*g* to open the stapler 301, as shown in FIG. 28. In this condition, one may replace a staple cartridge 301*d*.

Figure 15A:
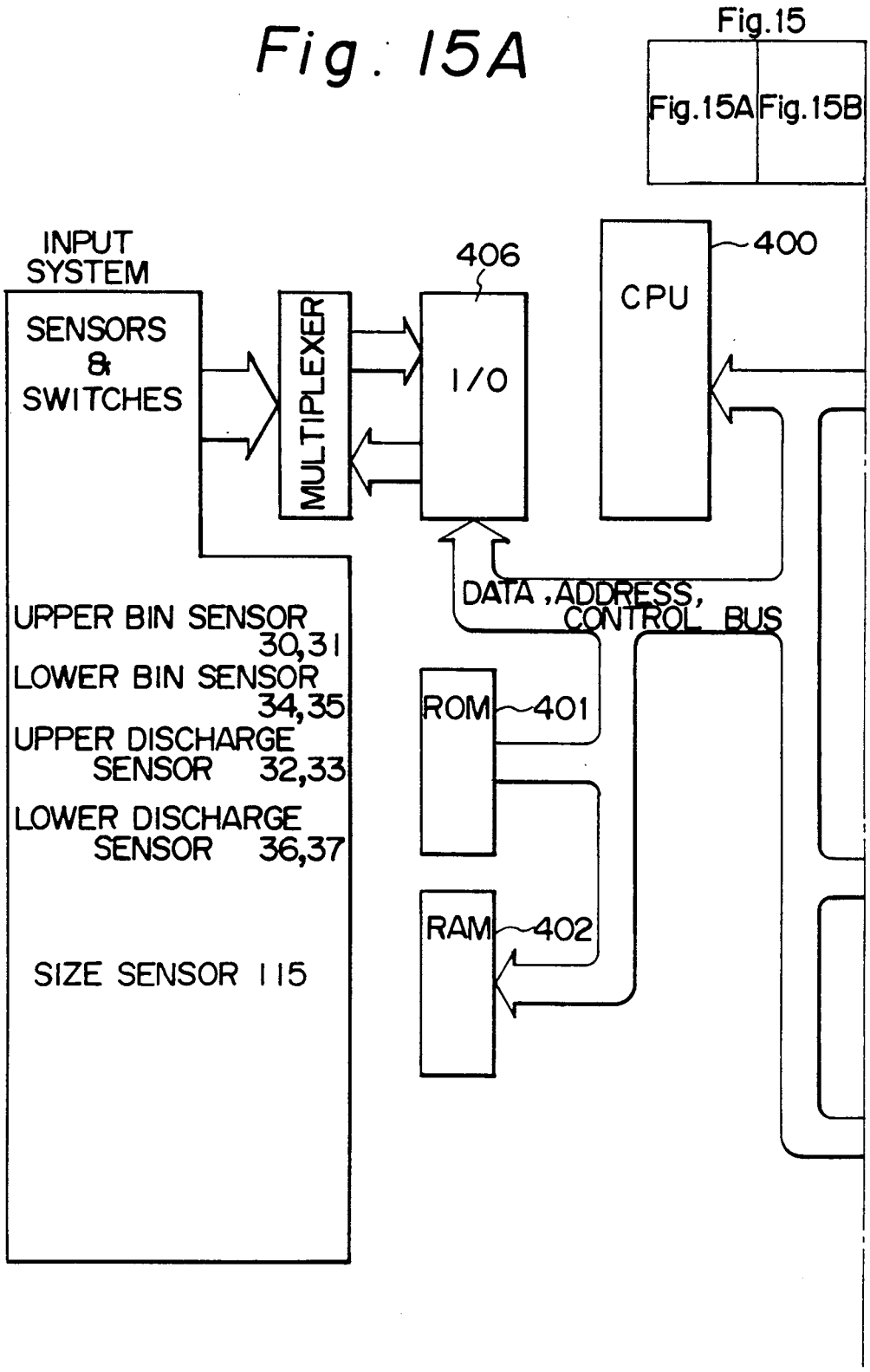
FIGS. 15A and 15B are a schematic block diagram showing a control circuit.
Figure 15B:
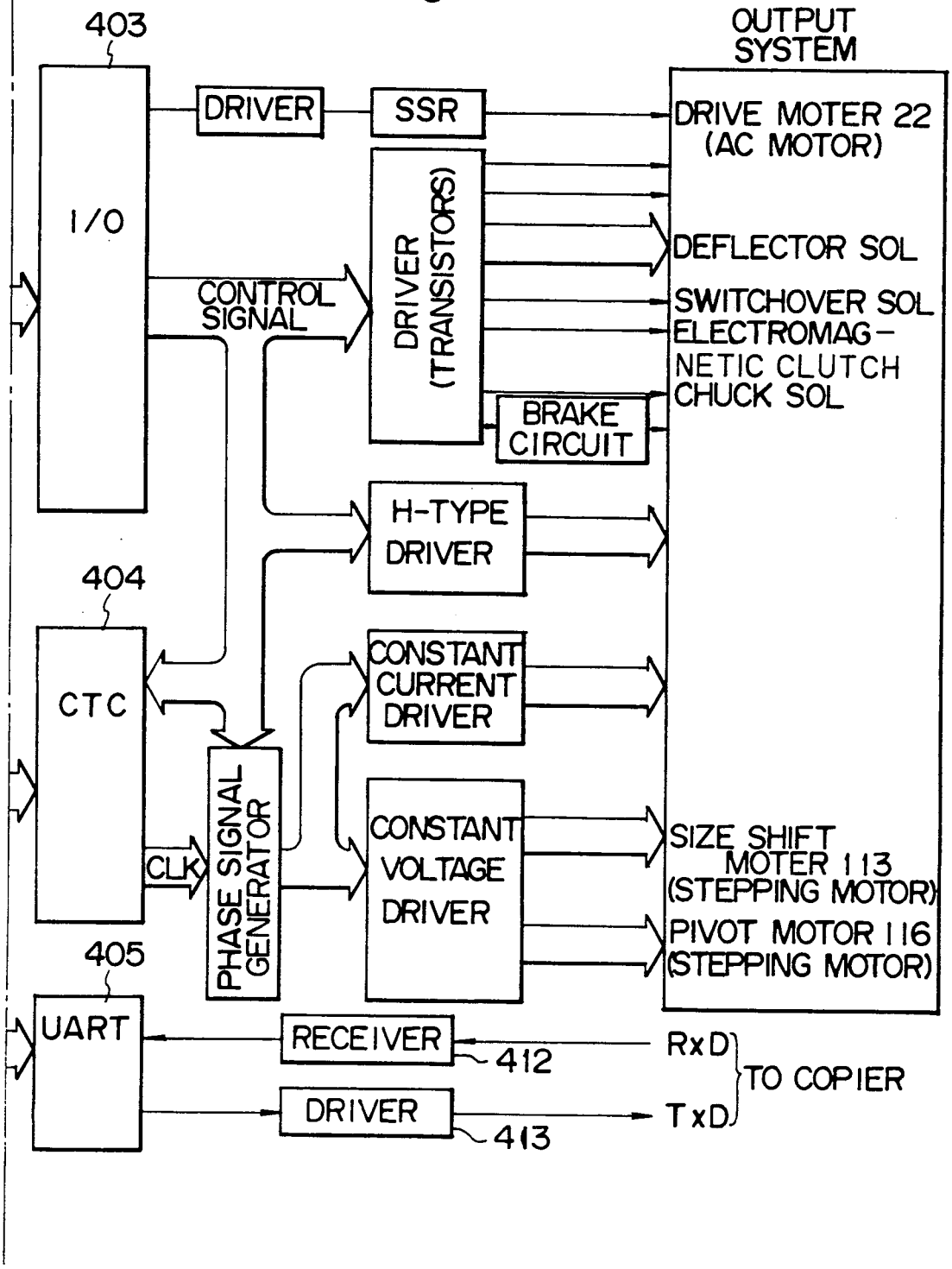

Referring to FIG. 15, a control system applicable to the illustrative embodiment is shown which is implemented as a microcomputer control system. As shown, the control system has a CPU 400, a ROM 401, a RAM 402, I/O ports 403 and 404, a clock timer controller (CTC) 404, and a universal asynchronous receiver/-transceiver (UART) 405. The ROM 401 is loaded with programs. The CPU 400 receives output signals of an the I/O pot 406 and, in response, controls various loads via the I/O port 403, CTC 404 and various drivers. The CPU 400 interchanges various statuses and command signals with the copier via the UART 405 and a receiver 412 and a driver 413.

The copier sends to the sorter and stapler a sorter start signal, a copier discharge signal, a mode signal, a size signal, a staple start signal, a staple end signal, a serviceman call reset signal (S.C. reset), etc. On the other hand, the sorter and stapler sends to the copier a discharge signal, a door cover open signal, a jam signal, a short bin signal, a failure signal, a no staple signal, an end-of-staple signal, a ready-to-staple signal, a ready-to-sort signal, etc.

The operation and control particular to the illustrative embodiment will be described by using flowcharts.

Figure 16:
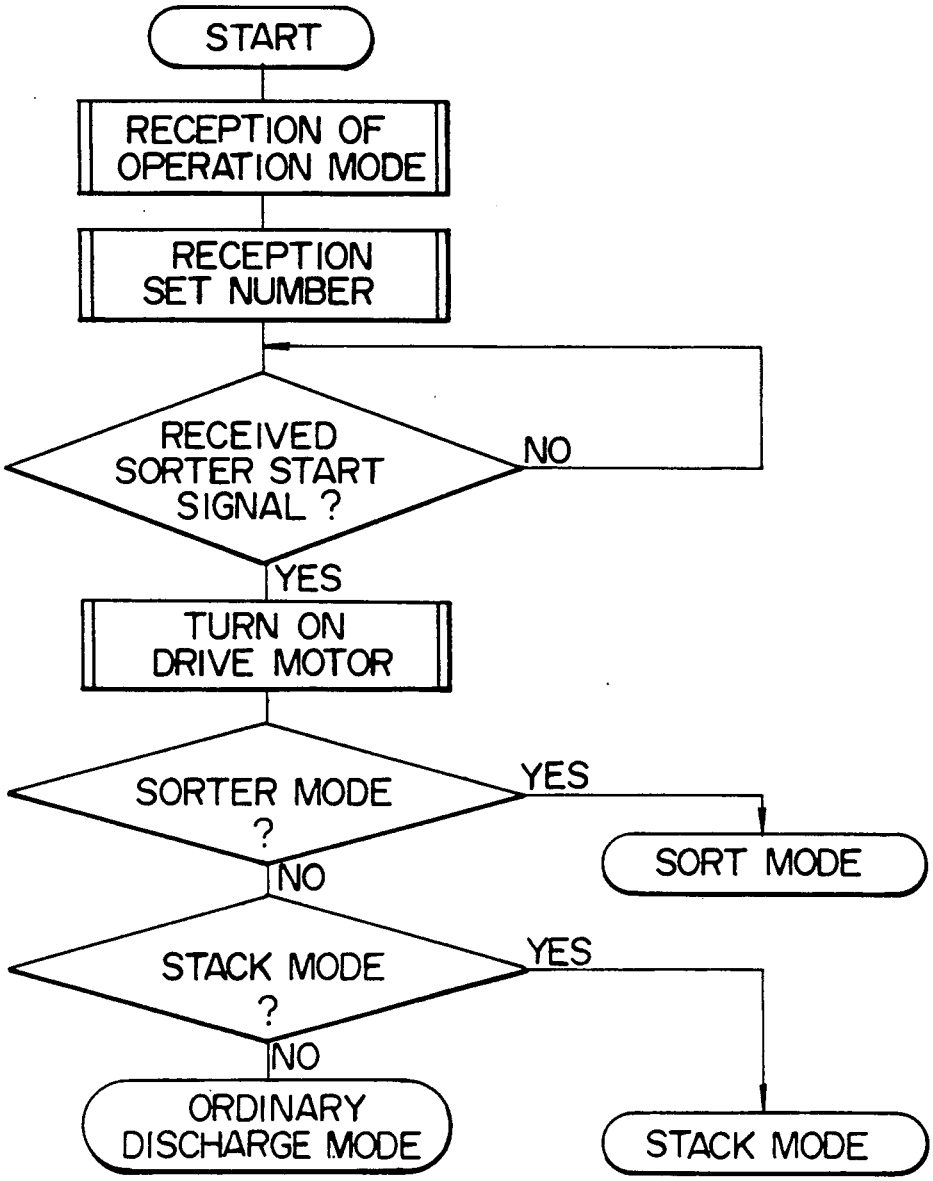
FIGS. 16 to 22 are flowcharts representative of specific operations of the control circuit.

FIG. 16 shows a main routine. First, an operation mode signal from the copier is received, and then a set number signal from the copier is received. After starting a copying operation, the copier sends a sorter start signal. After the copier has started on a copying operation, it sends a sorter start signal. In response, the drive motor 22 is energized to set up a sort mode. Before the arrival of the sorter start signal, a waiting state is maintained. Thereafter, any one of a sort mode, stack mode and ordinary paper discharge mode is executed on the basis of the received operation mode. In the ordinary paper discharge mode, paper sheets will be successively fed out onto the tray 3.

Figure 17A:
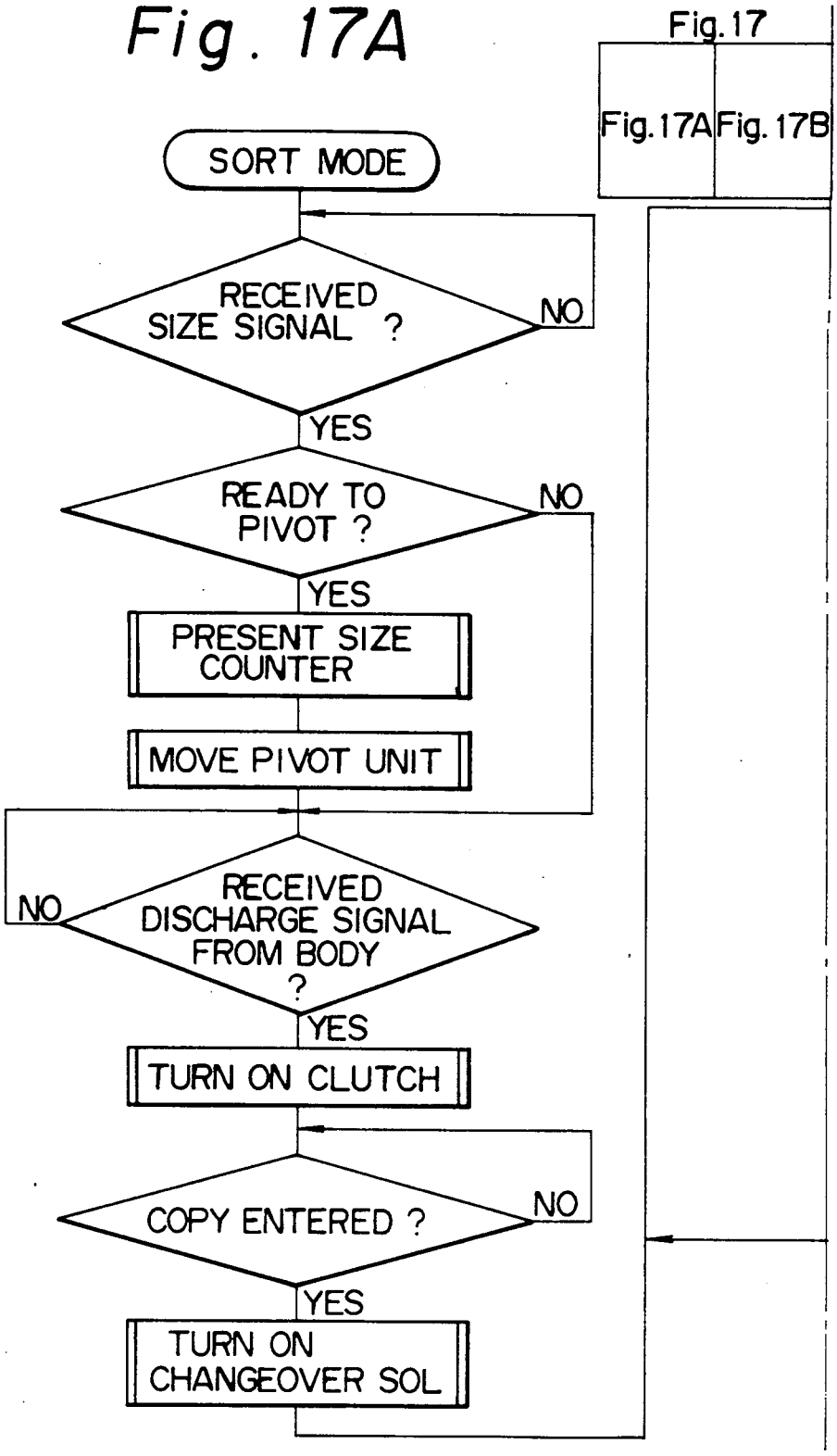
Figure 17B:
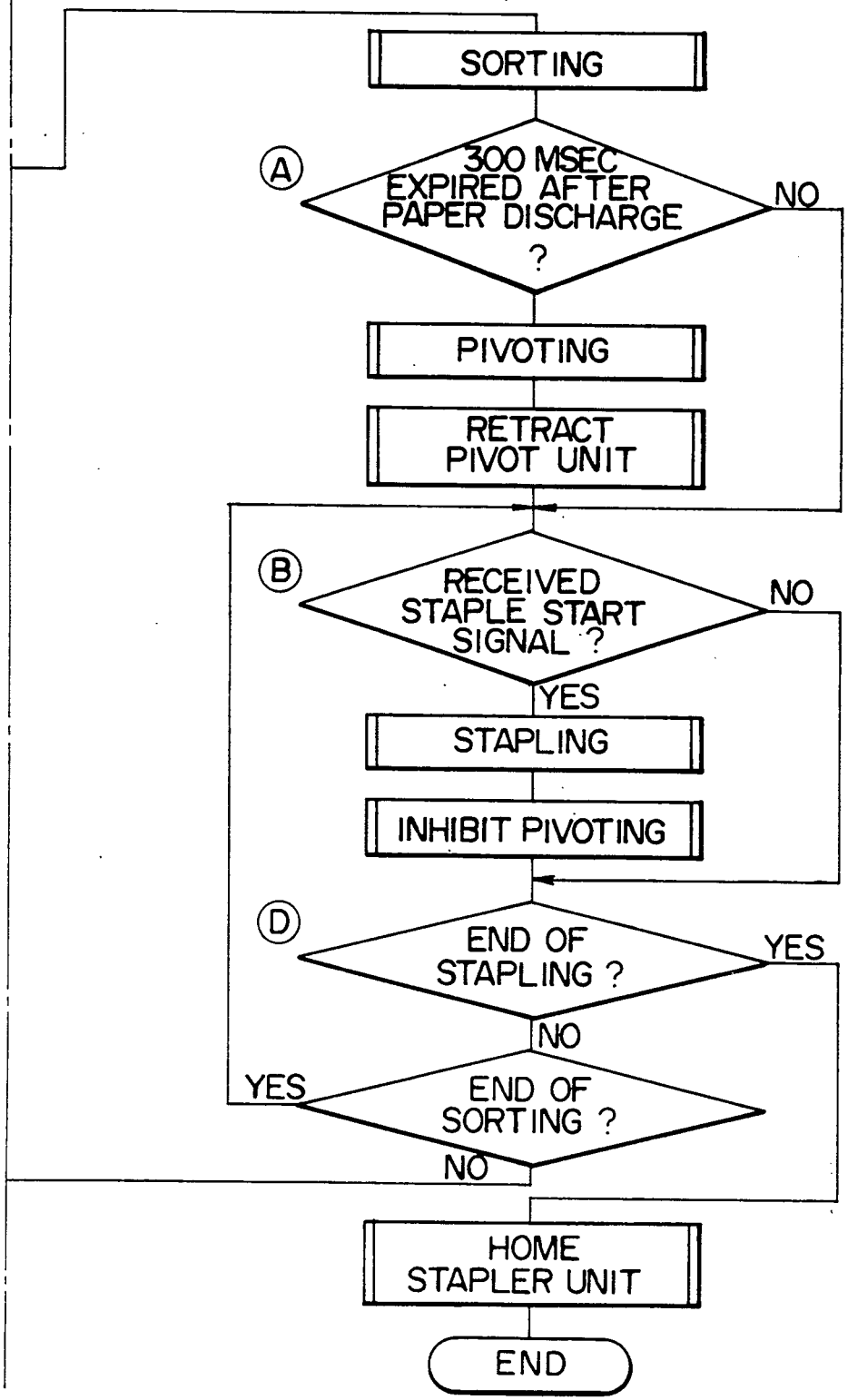

As shown in FIG. 17, in the sort mode, a size signal indicative of the size of paper sheets fed from the copier arrives a little later than the sorter start signal. In response to the size signal, whether or not the pivoting unit is ready is determined (not ready when sheets from the outside are laid on the bins in the stack mode). If the pivoting unit is ready, the program advances to a size counter preset routine and a pivoting unit move subroutine. In these subroutines, the pivoting unit, i.e., the pusher 102 and other components are moved to a position matching the paper size signal.

Figure 18:
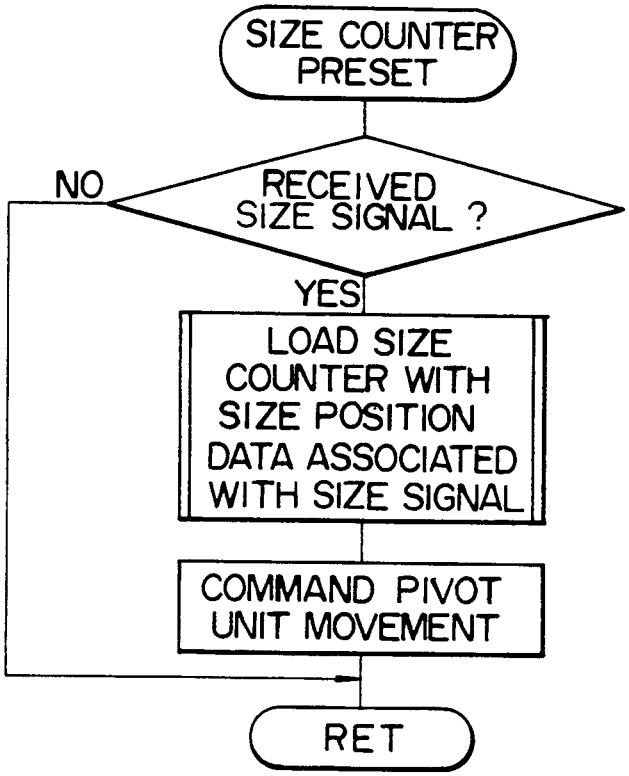

In FIG. 18, the size counter preset subroutine is such that if the size signal has been received, size position data matching the size signal is loaded in a size counter and a pivoting unit shift command is delivered. Then, the program returns. If the size signal has not been received, the program directly returns.

Figure 19:
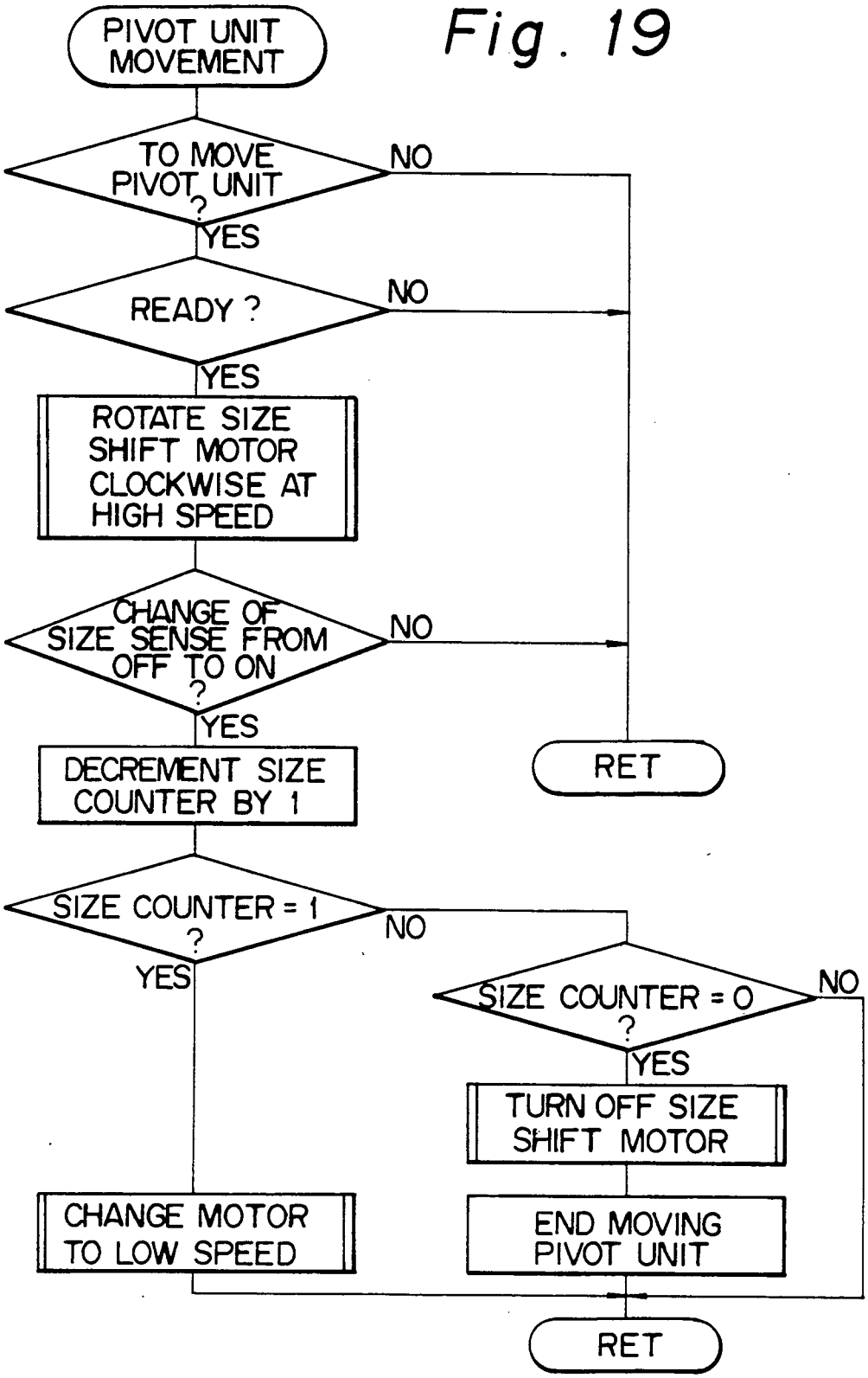

In FIG. 19, the pivoting unit shift subroutine is shown. If the pivoting unit is not to be moved, the program returns. If the pivoting unit is to be moved, whether or not the pivoting unit is ready to move is determined. If it is ready to move, the size motor 113 is rotated clockwise at a high speed. Then, whether or not the size sensor 115 has turned from OFF to ON is determined. If it has not turned from OFF to ON, the program returns. If it has been done so, the size counter is decremented by 1 and the size counter is checked. If the size counter is 1, the speed of the size shift motor 113 is lowered and the program returns. If the size counter is 0, the size shift motor 113 is deenergized and the program returns. On the completion of the pivoting unit move subroutine, in FIG. 17, a discharge signal from the copier body is checked. On the reception of a discharge signal, the electromagnetic clutch (CL) (FIG. 5) is turned on. Then, the rotation of the drive motor 22 is imparted to the transport rollers 19 to rotate them.

As the copy arrives at the sorter, the inlet sensor S (FIG. 5) is turned on to in turn energize the changeover SOL (FIG. 5). The changeover SOL shifts the selector 15 to the path which terminates at the bins.

In a step labeled "SORTING" in FIG. 17, processing for distributing the copy to particular one of the bins is executed. For example, only the deflector 18 associated with the desired bin is switched over. On the lapse of a suitable period of time necessary for the copy to be fully laid on the bin (e.g. 300 milliseconds, step A of FIG. 17), a pivot subroutine is executed so as to cause the pusher 102 shown in FIG. 4 to pivot for thereby positioning a paper stack on a bin.

Figure 20:
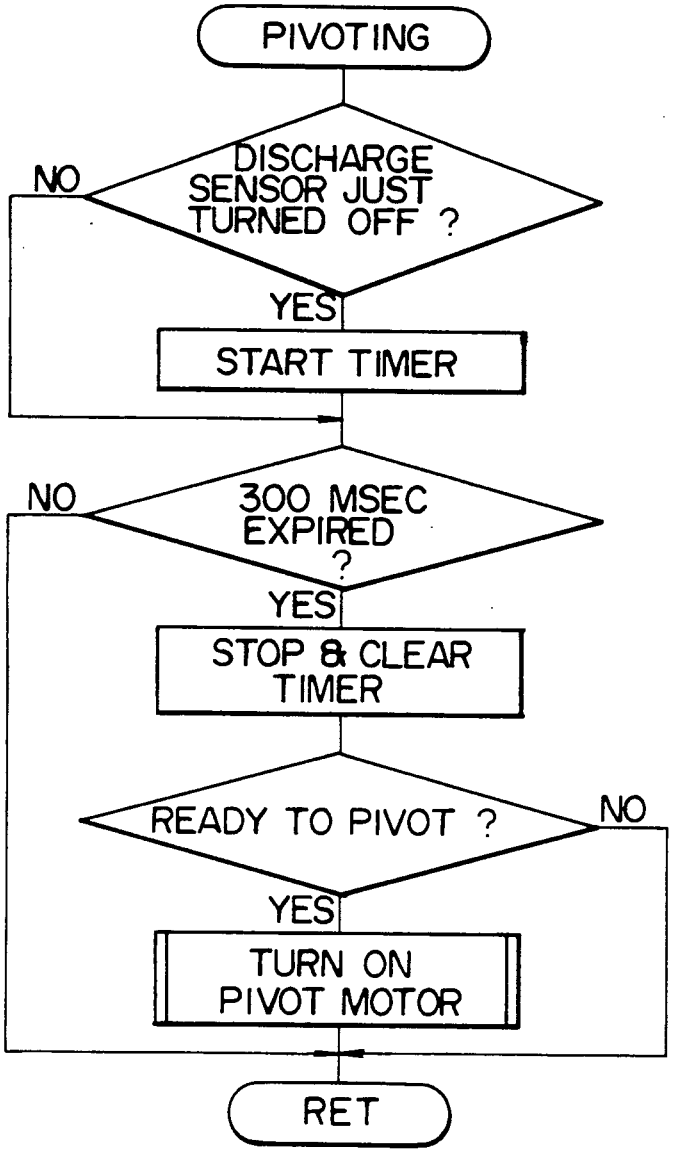

Specifically, in the pivot routine shown in FIG. 20, when the copy is driven out onto the bin, either the discharge sensor 32 and 33 or the discharge sensor 36 and 37 (FIG. 6) is turned on. At the end of the discharge, the sensor turns from ON to OFF. The turn from ON to OFF is representative of the trailing edge of the copy. On the turn of the discharge sensor 629 or 628 as mentioned above, a timer built in the CPU 400 is started. When a predetermined period of time, 300 milliseconds in the illustrative embodiment, expires as determined by monitoring the timer, the timer is stopped and, if the pivoting unit is ready, the pivot motor 116 is turned on to cause the main shaft 101 and thereby the pusher 102 into a pivoting motion. This is repeated every time a copy is discharged onto the bin. After the pivot subroutine, the operation advances to a pivoting unit retract subroutine. When the number of copies sequentially stacked on the bin has exceeded the number which is available with the stapler unit (thirty copies in the illustrative embodiment), the pivot which will obstruct the sorting is interrupted, the pivoting unit is retracted to the home position, and the stapler unit is inhibited from binding the copies on the bin.

Figure 21:
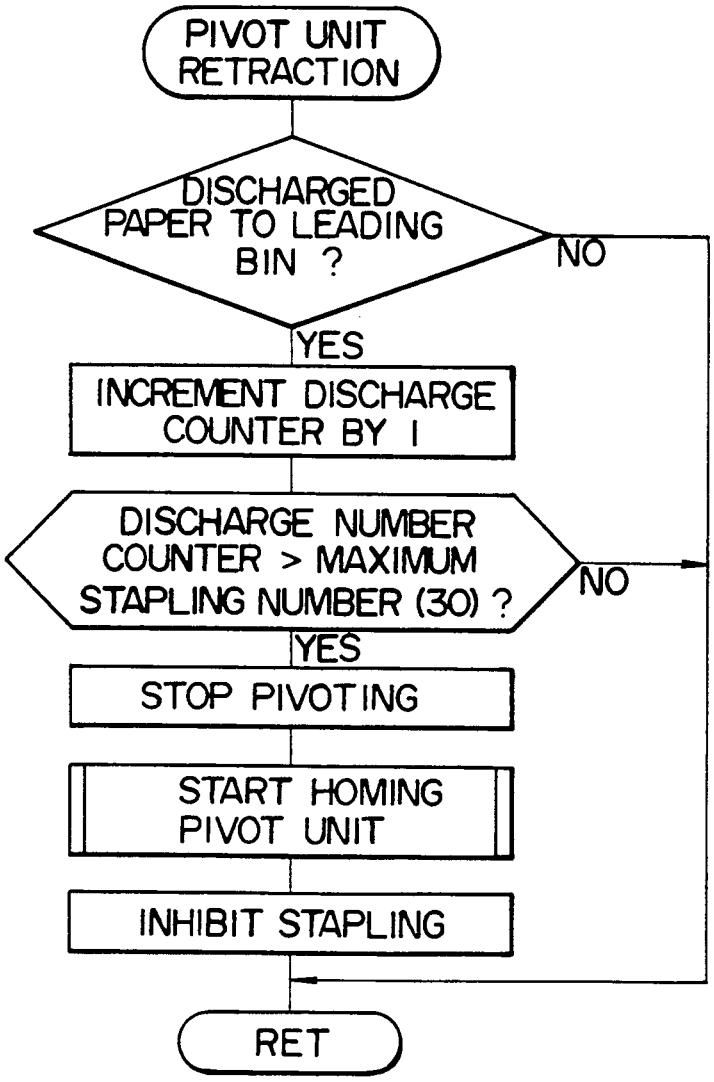

In FIG. 21 showing the pivoting unit retract subroutine, when a copy is discharged onto the leading bin (step 58-1), it is counted. When the number of discharged copies has exceeded the number which can be stapled, the pivoting operation is interrupted and the pivoting unit is retracted to the home position. The next copy and successive copies discharged onto the bin are not regulated in position. At the same time, the stapling operation with the previously discharged copies is also inhibited.

After the above procedure, whether or not a staple start signal has been sent from the copier is determined in a step B shown in FIG. 17 and, if it has been sent, staple processing is executed. In a step labeled "STAPLING" in FIG. 17, the stapler 301 and chucking unit 302 are moved integrally with each other while stopping at each of the bins. The chucking unit 302 pulls a paper stack from each bin to the stapler 301, and the stapler 301 staples it. The bin fence 210 shown in FIG. 4 defines a reference position when the pusher 102 is pivoted to position paper sheets. During the stapling operation, however, the bin fence 210 obstructs the movement of paper sheets. To solve this problem, an arrangement is made such that when the stapler 301 and chucking unit 302 have reached a bin of interest, the bin fence 210 is automatically rotated downward as indicated by an arrow Q to a retracted position where it does not interfere with paper sheets.

In FIG. 17, the staple processing is followed by a pivot inhibit subroutine for inhibiting the pivoting motion of the pusher 102. This subroutine will be executed when the positioning movement of the pusher 102 rather disturbs a copy stack.

Figure 22:
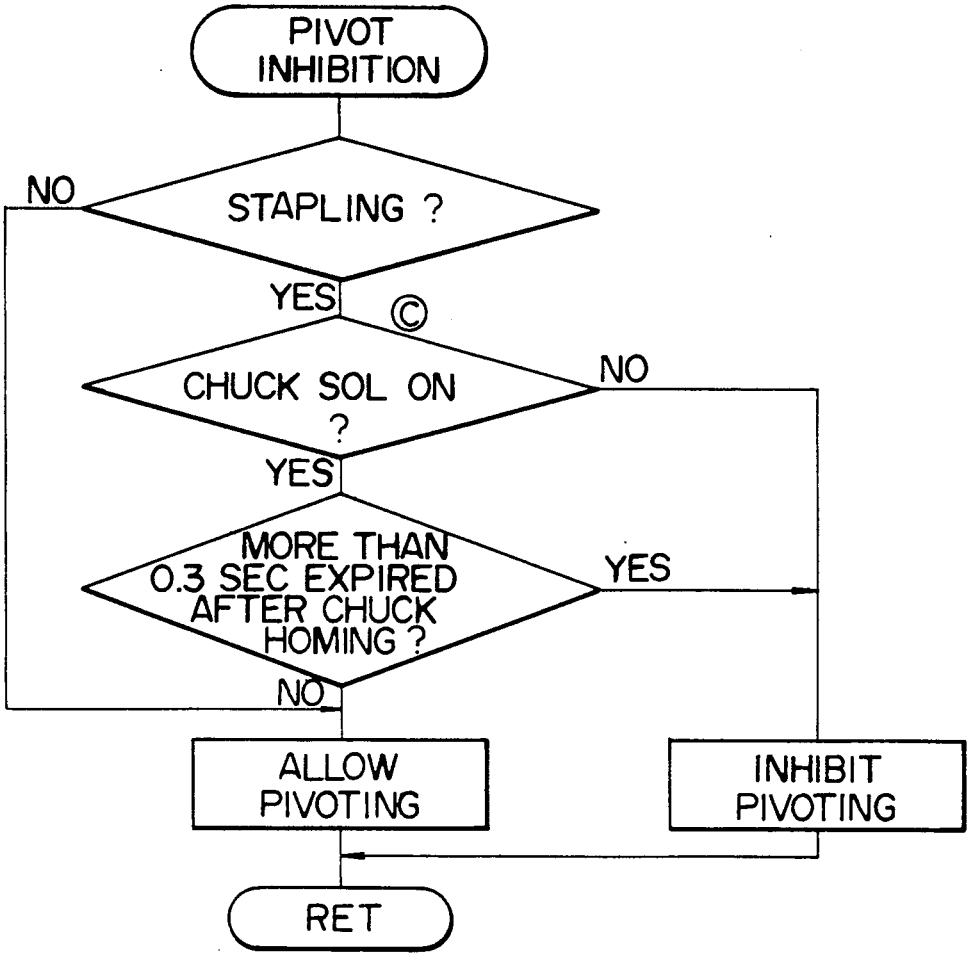

Specifically as shown in FIG. 22, whether or not a stapling operation is under way is determined. If it is not under way, meaning that the bin fence 210 is not open, the pivotal movement is allowed because it will not bring about any trouble. While a stapling operation is under way, whether or not a chuck solenoid 302-1C (FIG. 26) has been energized is determined. If the solenoid 302-1C has been turned on, the chucking unit 302 will be chucking a paper stack. During a staple mode operation, the stapler 301 and chucking unit 302 continuously move along the bins and, hence, the bin fence 210 of any one of the bins is necessarily open. At this instant, should the pusher 102 be pivoted with the chuck solenoid 302-1C being turned off, i.e., with the chucking unit 302 not chucking a paper stack, it would disturb the paper stack. In the light of this, the pivotal movement is inhibited when the solenoid 302-1C is turned off. When the solenoid 302-1C is turned on, whether or not more than 0.3 second has expired after the shift of the chuck to the position is determined.

If more than 0.3 second has expired, meaning that the stapler 301 has completed its action and the solenoid 302-1C is about to turn off, the pivotal movement of the pusher 102 is inhibited because it would be effected by the return of a stapled paper stack which occurs on the turn-off of the solenoid 302-1C and, as a consequence, copy sheets on the other bins would be dislocated. If more than 0.3 second has not expired, meaning that the solenoid 302-1C has surely gripped a paper stack, the pivotal movement is allowed because it does not effect the stapled paper stack. After the pivot inhibit subroutine, whether or not all the paper stacks loaded on the individual bins have been fully stapled is determined (step D, FIG. 17). If the answer of the step D is YES, the stapler 301 and its associated components are returned to the home position to terminate the entire operation.

While the illustrative embodiment has been shown and described in relation to a sorter for use with a copier, the present invention is of course applicable to a broad range of paper handling apparatuses including a sorter.

Finishing means associated with a paper handling apparatus of the kind to which the present invention pertains may be implemented as a puncher or a stamper in place of a stapler, and the present invention is practicable with such alternative finishing means also.

The present invention achieves various unprecedented advantages, as enumerated below.

(1) By a simple mechanical and control, the paper positioning device slows down a pivoting motion at a paper positioning position while accelerating it toward the paper positioning position and causes a paper positioning member to pivot twice by one reciprocating movement of a drive shaft. The device, therefore, positions a stack of paper sheets neatly. efficiently and, yet, positively without damaging the paper sheet, while the device itself is durable.

(2) The device has an elastic pushing member. When the device urges one end of a paper stack on a bin, the elastic pushing member urges the paper stack while being deformed. Hence, even when the amount of bite into a paper stack differs from one pushing member to another due to the mounting errors of individual bins, the device surely positions all the paper stacks. The elastic pushing member approaches a paper end receiving member after moving to a distance smaller than the widthwise dimension of paper sheets, the device is capable of positioning the paper sheets by surely pressing the end of the paper stack even when the paper stack is short of a predetermined width due to errors or curls. The pushing member does not rotate until it reaches a distance at least 10 millimeters smaller than the paper width to the paper end receiving member and, therefore, it does not urge a paper stack more than necessary and is free from excessive pivoting movements which would disturb a paper stack. Moreover, a single paper positioning member suffices to position a paper stack in two different directions with accuracy, because the elastic pushing member abuts against the paper stack such that the latter is urged against a first and a second stop member.

(3) The device positions paper sheets surely and positively without damaging them because it slows down the pivoting movement at the paper positioning position and accelerates it until the paper positioning position has been reached.

(4) The above advantage (3) is attainable without resorting to a complicated mechanism and control.

(5) The device causes the paper positioning member to pivot twice for one reciprocating movement of the drive shaft. This enhances efficient positioning operations by simple control while maintaining the durability of the device itself.

(6) The device has an auxiliary elastic member which is located at a predetermined level as measured from a sheet receiving surface. When paper sheets are curled, the auxiliary elastic member prevents them from slipping along the pushing member while the pushing member is moved to position the paper sheets. Since the auxiliary elastic member has a slant on the side where a paper sheet comes in, it surely guides the paper sheet onto the paper receiving member even if it is curled. Further, when a paper stack is thicker than usual due to curls, the auxiliary elastic member does not interfere with the entry of a paper sheet due to deformation.

(7) When the elastic pushing member urges the end of a paper stack on the associated receptacle, it does so in a deformed position due to elasticity. Hence, the device surely positions all the paper stacks despite any scattering in the amount of bite of the pushing member into a paper stack which is ascriable to the mounting errors of the individual receptacles.

(8) The device has moving means for moving the paper positioning member to an adequate position matching a paper size and causing it to pivot there, whereby paper sheets are positioned with accuracy with no regard to the paper size.

(9) The paper positioning member is moved to an adequate position associated with incoming paper sheets and then pivoted there, thereby positioning the paper sheets accurately.

(10) The movement of the paper positioning member is slowed down when it reaches a stop position just before a stop position associated with the size of incoming paper sheets. Hence, the sheet positioning member is brought to a stop with accuracy to further promote accurate paper positioning.

(11) The paper positioning member begins pivoting by taking account of the timing at which a paper sheet distributed onto the receptacle drops along the inclination of the receptacle. A paper sheet is, therefore, positioned not only in a direction perpendicular to an intended direction paper discharge but also in the intended direction of paper discharge.

(12) All the paper sheets introduced into the receptacles are surely positioned.

(13) The trailing edge of a paper sheet with respect to the intended direction of paper discharge is positioned with accuracy.

Various modifications will become possibel for those skilled in the art after receiving the teachings of the present disclosure without departing from the scope thereof.

What is claimed is:

1. A paper positioning apparatus comprising:

a receptacle for receiving a paper sheet; and a paper positioning member pivotable in abutment against an edge of the paper sheet loaded at said receptacle for moving said paper sheet from a position where said paper sheet is laid to a positioning position;

wherein said receptacle comprises:

a paper end receiving member inclined upward toward a downstream side with respect to an intended direction of paper discharge onto said receptacle; and a stop member for stopping the paper sheet which drops toward an upstream side with respect to said intended direction of paper discharge;

wherein said receptacle has a paper receiving surface which is provided with either one of a recess and a slot through which a pushing portion of said paper positioning member moves for pushing the paper sheet during pivotable movement of said paper positioning member;

wherein said stop member extends upward substantially perpendicularly to said paper receiving surface of said receptacle and said paper positioning means comprises driving means, a crank mechanism, a rotatable shaft, moving means, and position sensing means; and wherein said driving means comprises a drive shaft for imparting a torque to said crank mechanism;

said crank mechanism comprising:

a connecting member rotatably mounted on said drive shaft; and a rotatable arm having at one end thereof an engaging portion in which said connecting member is slidably received and being rotatable about a fulcrum which is defined by the other end in response to a rotary motion of said connecting member;

said rotatable shaft rigidly mounting one end of said paper positioning member and being rigidly connected to said fulcrum of said rotatable arm to be rotated by said rotatable arm;

said position sensing means being responsive to sense a plurality of stop positions at which said paper positioning member is selectively stopped and then pivoted, each of said stop positions being associated with respective one of paper sizes; and said moving means moving said paper positioning member to one of said stop positions which is associated with a size of the paper sheet and, when said position sensing means has sensed one of said stop positions just before said stop position associated with said size of said paper sheet, lowering a moving speed of said paper positioning member.

2. An apparatus as claimed in claim 1, further comprising sensing means for sensing discharge of the paper sheet onto said receptacle;

said driving means beginning driving on lapse of a predetermined period of time after said sensing means has sensed discharge of said paper sheet;

said drive shaft of said driving means rotating said paper positioning means in one direction in a pivoting motion and then rotating in the other direction after said paper positioning member has moved beyond a maximum pivotable position.

3. An apparatus as claimed in claim 2, wherein said paper positioning member comprises an elastic pushing member and an elastic auxiliary pushing member;

said auxiliary pushing member being fixed to said paper positioning member slightly above a thickness of a paper stack as measured from said paper receiving surface of said receptacle, said auxiliary pushing member being spaced apart more at an upstream side as seen in an intended direction of paper discharge than at a downstream side and being sequentially inclined from said upstream side toward said paper receiving surface;

said elastic pushing member being affixed to a free end portion of said paper positioning member remote from said rotatable shaft and being rotated by said rotatable shaft at least by an angle between a first and a second position where said elastic pushing member contacts and does not contact respectively the paper sheet loaded on said receptacle, said rotation of said elastic pushing member occurring in a direction for urging said paper sheet against said paper end receiving member and said stop member.

4. An apparatus as claimed in claim 3, wherein an amount of pivoting movement of said paper positioning member relative to said paper end receiving member is such that a distance between said paper end receiving member and said elastic pushing member is slightly smaller than a width of the paper sheet and is greater than a distance which is 10 millimeters smaller than said width of said paper sheet.

5. A paper positioning device comprising a pivotable paper positioning member which abuts against an edge of a paper sheet loaded on a paper receiving surface of a receptacle for moving said paper sheet from a loaded position to a paper positioning position, said device comprising:

driving means comprising a drive shaft for imparting a torque;

a crank mechanism comprising a connecting member driven by said driving means in a rotary motion about said drive shaft, and an arm having at one end an engaging portion in which said connecting member is slidably received and being rotatable about a fulcrum defined at the other end in response to a rotary motion of said connecting member;

a rotatable shaft rigidly connected to said fulcrum and rotatable in response to rotation of said arm, said paper positioning member being mounted on said rotatable shaft; and control means for controlling said driving means such that said drive shaft is rotated in one direction for causing said paper positioning member to pivot and, after said paper positioning member has passed a maximum pivoting position, rotated in the other direction;

said paper positioning member being moved at a lower speed when moved the paper sheet to said paper positioning position than when moving said paper sheet toward said paper positioning position.

6. In a paper positioning device comprising a pivotable paper positioning member which abuts against an edge of a paper sheet loaded on a paper receiving surface of a receptacle for moving said paper sheet from a loaded position to a paper positioning position, the improvement comprising means for moving said paper position member at a lower speed when moving the paper sheet to said paper positioning position than when moving said paper sheet toward said paper positioning position.

7. A device as claimed in claim 6, wherein said paper positioning member is caused to pivot by a rotary shaft which is rotated by a crank mechanism.

8. A paper positioning device comprising a pivotable paper positioning member which abuts against an edge of a paper sheet loaded on a receptacle for positioning said paper sheet, said device comprising:

driving means comprising a drive shaft for imparting a torque;

a connecting member driven by said driving means in a rotary motion about said drive shaft;

an arm having at one end an engaging portion in which said connecting member is slidably received and being rotatable about a fulcrum defined at the other end in response to a rotary motion of said connection member;

a rotatable shaft rigidly connected to said fulcrum and rotatable in response to rotation of said arm, said paper positioning member being mounted on said rotatable shaft and pivotable into abutment against the edge of the paper sheet; and control means for controlling said driving means such that said drive shaft is rotated in one direction by more than 180° for causing said paper positioning member to pivot past a maximum pivoting position and, after said paper positioning member has passed the maximum pivoting position, rotated in the other direction so that said paper positioning member is caused to pivot twice.

9. A paper positioning device comprising:

a receptacle for selectively receiving paper sheets of a plurality of sizes;

a paper positioning member pivotable in abutment against an edge of the paper sheets while being held at any one of a plurality of predetermined stop positions each being associated with respective one of the plurality of sizes of the paper sheets;

moving means for moving said paper positioning member to any one of said stop positions depending on the size of a selected paper sheet;

sensing means for sensing a position of said paper positioning member; and control means for stopping a movement of said paper positioning member when said position sensing means senses that said paper positioning member has reached one of said stop positions associated with the size of the paper sheets discharged;

wherein said control means lowers a moving speed of said paper positioning member when said position sensing means senses that said paper positioning member has reached one of the stop positions which is just before the stop position associated with the size of the paper sheets.

* * * * *